US008752491B2

(12) United States Patent
Nagai et al.

(10) Patent No.: US 8,752,491 B2
(45) Date of Patent: Jun. 17, 2014

(54) SEWING MACHINE

(75) Inventors: Masahiko Nagai, Nagoya (JP); Masaru Jimbo, Kasugai (JP); Eiichi Hamajima, Kasugai (JP); Toru Imaeda, Ichinomiya (JP); Hiroshi Yamasaki, Nagoya (JP); Daisuke Ueda, Owariasahi (JP); Yasuhiro Ishiyama, Kaohsiung (TW)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 704 days.

(21) Appl. No.: 13/029,790

(22) Filed: Feb. 17, 2011

(65) Prior Publication Data

US 2011/0203505 A1 Aug. 25, 2011

(30) Foreign Application Priority Data

Feb. 25, 2010 (JP) ..... 2010-040265

(51) Int. Cl.
*D05B 29/02* (2006.01)

(52) U.S. Cl.
USPC ..... 112/239

(58) Field of Classification Search
USPC ..... 112/235, 236, 237, 238, 239
See application file for complete search history.

(56) References Cited

U.S. PATENT DOCUMENTS

| | | | | |
|---|---|---|---|---|
| 4,674,424 | A * | 6/1987 | Shiomi et al. | 112/237 |
| 4,704,978 | A * | 11/1987 | Nomura et al. | 112/275 |
| 5,144,900 | A * | 9/1992 | Takahashi | 112/470.04 |
| 5,331,909 | A * | 7/1994 | Tajima et al. | 112/103 |
| 5,899,157 | A * | 5/1999 | Kurono et al. | 112/470.01 |
| 5,947,043 | A * | 9/1999 | Morita et al. | 112/102.5 |
| 6,298,799 | B1 * | 10/2001 | Hirose | 112/102.5 |
| 7,290,493 | B2 * | 11/2007 | Suzuki et al. | 112/220 |
| 2011/0290168 | A1 * | 12/2011 | Kawai | 112/236 |
| 2012/0017815 | A1 * | 1/2012 | Fujihara | 112/235 |

FOREIGN PATENT DOCUMENTS

JP A-11-019358 1/1999

* cited by examiner

*Primary Examiner* — Danny Worrell
(74) *Attorney, Agent, or Firm* — Oliff PLC

(57) ABSTRACT

A sewing machine is disclosed that includes a needle bar allowing attachment of a sewing needle including a needle eye to a lower end of thereof; a needle-bar lifting/lowering mechanism that moves the needle bar up and down; a presser foot; a presser foot lifting/lowering mechanism that moves the presser foot up and down; a hook that is provided with a beak for seizing a needle thread loop formed at the needle eye and that rotates in coordination with the up and down movement of the needle bar; and a controller that controls the presser foot lifting/lowering mechanism so as to resize a needle thread loop by lifting the presser foot to a predetermined height in coordination with a swing position of the needle bar and a predetermined height of the needle bar where the beak meets the needle thread loop.

6 Claims, 22 Drawing Sheets

SEWING MACHINE

CROSS-REFERENCE TO RELATED APPLICATIONS

This application is based upon and claims the benefit of priority from the prior Japanese Patent Application 2010-040265, filed on Feb. 25, 2010, the entire contents of which are incorporated herein by reference.

FIELD

The present disclosure relates to a sewing machine provided with a presser foot lifting/lowering mechanism that moves the presser foot up and down.

BACKGROUND

In the field of sewing machines, a device for automatically varying the pressure applied on a workpiece cloth by a presser foot is known that varies the pressure with the variation in machine speed typically represented by SPM (Stitches Per Minute). Such device controls the pressure imparted by the presser foot to increase with machine speed in order to suppress presser foot jumping which intensifies with machine speed.

In operation, sewing machine pierces the workpiece cloth with a threaded sewing needle and forms a needle thread loop at the needle eye as the sewing needle is lifted out of the workpiece cloth. Needle thread loop is a small loop formed by the needle thread running between the needle eye and the workpiece cloth. The needle thread loop is seized by the hook beak to allow the bobbin thread to be passed through it to create a seam on the workpiece cloth with the interlaced needle thread and bobbin thread.

In sewing machines that are provided with a needle bar swing mechanism that laterally swings the needle bar, hook beak meets the sewing needle in different timings when needle bar is placed in the left baseline position (i.e. left needle drop position) and the right baseline position (i.e. right needle drop position). Meeting or encounter of the hook beak and the sewing needle in this context indicates the timing in which the tip of the beak overlaps with the sewing needle when viewed from the front side of the sewing machine. The beak seizes the needle thread loop at this timing and thus, this timing can also be deemed as the meeting point of the beak and the needle thread loop. Normally, the beak meets the sewing needle at an earlier timing when the needle bar is placed in the right baseline position as compared to the left baseline position. The size of the needle thread loop relies on the amount of elevation the sewing needle pierced through the workpiece cloth travels until it meets the beak. Thus, the size of the needle thread loop varies depending upon the position in which the needle bar is swung.

Such being the case, the needle thread loop may become oversized in certain needle swing positions and may sag or topple by gravity to lose its shape. This disables the loop seizure on the part of the beak to cause sew errors such as skipped stitches As mentioned earlier, the size of the needle thread loop relies on the amount of elevation the sewing needle pierced through the workpiece cloth travels until it meets the beak. When raising the sewing needle, the workpiece cloth must be pressed down by the presser foot. Failure to do so will result in the elevation of the workpiece cloth with the sewing needle which will not allow the needle thread loop to form. The inventors of the present disclosure conceived of adjusting the size of the needle thread loop by slightly reducing the pressure applied by the presser foot, that is, allowing the elevation of the workpiece cloth W in controlled amounts with the rising of the sewing needle. The inventors have realized such loop size adjustment feature through control of the presser foot lifting/lowering mechanism to provide a sewing machine that is preventive of skipped stitches.

SUMMARY

One object of the present disclosure is to provide a sewing machine that prevents skipped stitches through control of a presser foot lifting/lowering mechanism.

In one aspect, the present disclosure discloses a sewing machine including a needle bar that allows attachment of a sewing needle including a needle eye to a lower end of thereof; a needle-bar swing mechanism that swings the needle bar; a needle-bar lifting/lowering mechanism that moves the needle bar up and down; a presser foot that presses a workpiece cloth; a presser foot lifting/lowering mechanism that moves the presser foot up and down; a hook that is provided with a beak for seizing a needle thread loop formed at the needle eye and that rotates in coordination with the up and down movement of the needle bar; a controller that controls drive of the presser foot lifting/lowering mechanism; wherein the controller controls the presser foot lifting/lowering mechanism so as to resize the needle thread loop by lifting the presser foot to a predetermined height in coordination with a swing position of the needle bar and a height of the needle bar where the beak meets the needle thread loop.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

One exemplary embodiment of the present disclosure will be described with reference to the drawings.

Figure 1:
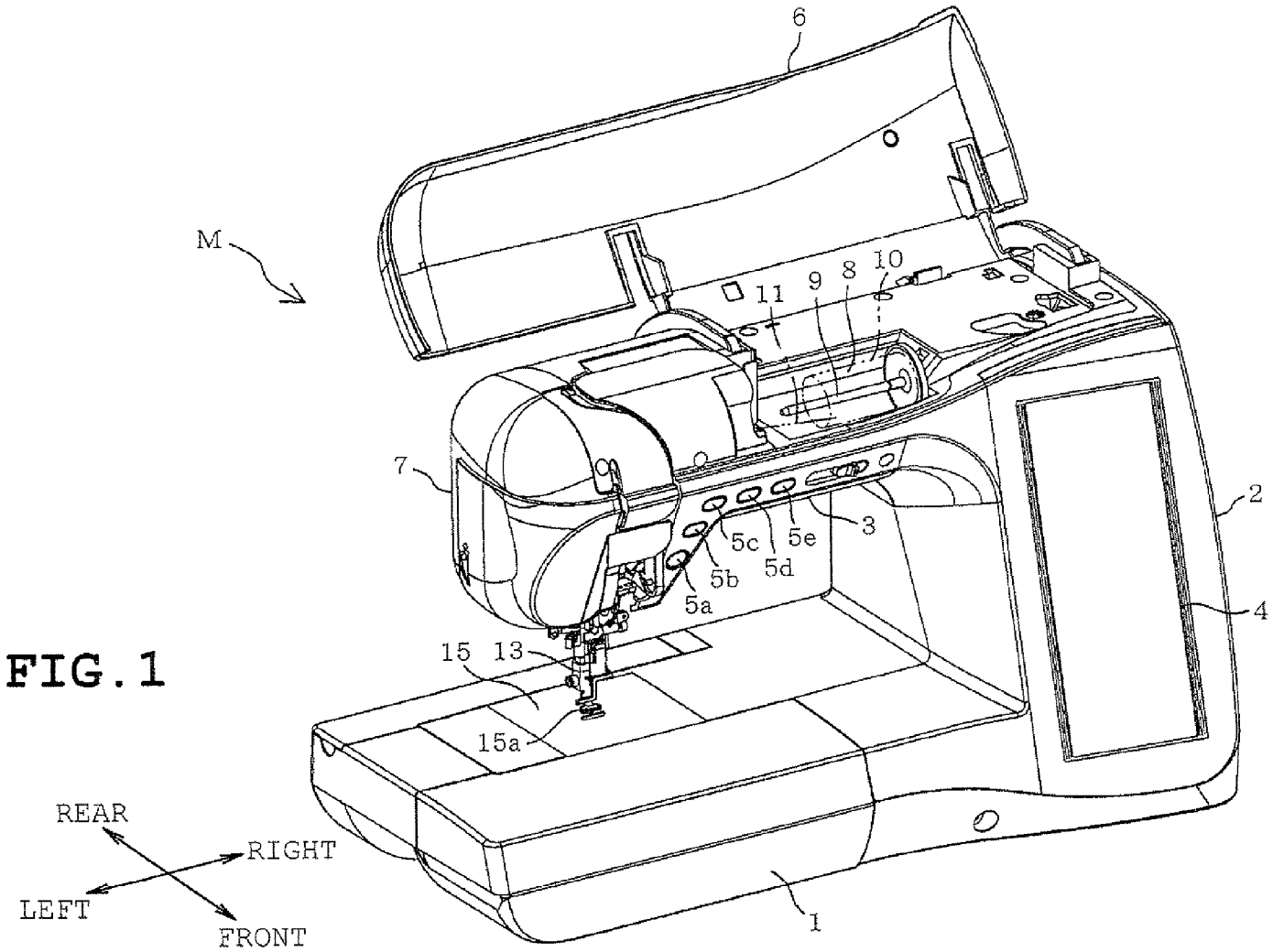
FIG. 1 is a general perspective view of a sewing machine according to a first exemplary embodiment of the present disclosure.

As typically shown in FIG. 1, sewing machine M includes components such as bed 1, pillar 2, and arm 13. Pillar 2 extends upward from the right end of bed 1 and has arm 13 extending leftward over bed 1 from its upper end. Throughout the description given herein, the direction where the user, or the operator, of sewing machine M positions himself relative to sewing machine M is defined as the forward direction/front side where components such as later described liquid crystal display 4 and control switches 5 are provided, and the opposing side, naturally, is defined as the rear direction/rear side. The direction in which pillar 2 is displaced from the lateral center of bed 1 is defined as the rightward direction/right side and the opposing side, naturally, is defined as the leftward direction/left side.

On the front face of pillar 2, a liquid crystal display 4 hereinafter also referred to as LCD 4 is provided, whereas on the lower front face of arm 3, various switches such as sew start switch 5*a*, sew end switch 5*b*, automatic threading setup switch 5*c*, presser foot lifting/lowering switch 5*d*, and automatic threading start switch 5*e* are provided.

At the upper portion of arm 13, openable/closable cover 6 is attached that extends substantially throughout the entire length of arm 3 in the left and right direction. Cover 6 is opened/closed through rotation about a rotary shaft not shown provided at the upper rear end portion of arm 3 to open/close the upper portion of arm 3. Arm 3 terminates into head 7 and to the right of head 7, thread storage slot 8 is defined so as to be situated on the upper portion of arm 3. Within thread storage slot 8, thread spool pin 9 is provided which is inserted through thread spool 10 to hold thread spool 10 in a landscape orientation within thread storage slot 8. Needle thread 11 drawn from thread spool 10 is engaged with a number of components such as a thread tension regulator not shown, a check spring not shown, and thread take-up 28 shown in FIG. 3 to be ultimately fed to sewing needle 13 detachably and interchangeably attached to the lower end of needle bar 12 shown in FIG. 3.

Sewing needle 13 has groove 13*a* defined on its front side facing forward relative to sewing machine M when attached to needle bar 12. Groove 13*a* runs along the lengthwise direction or the up and down direction of sewing needle 13 as shown in FIGS. 19 to 23 that terminates into needle eye 13*b* that longitudinally penetrates sewing needle 13. Needle thread 11 fed from thread spool 10 is guided into needle eye 13*b* by groove 13*a*. Threading device not shown for threading needle thread 11 through needle eye 13*b* is provided in the proximity of sewing needle 13.

Figure 3:
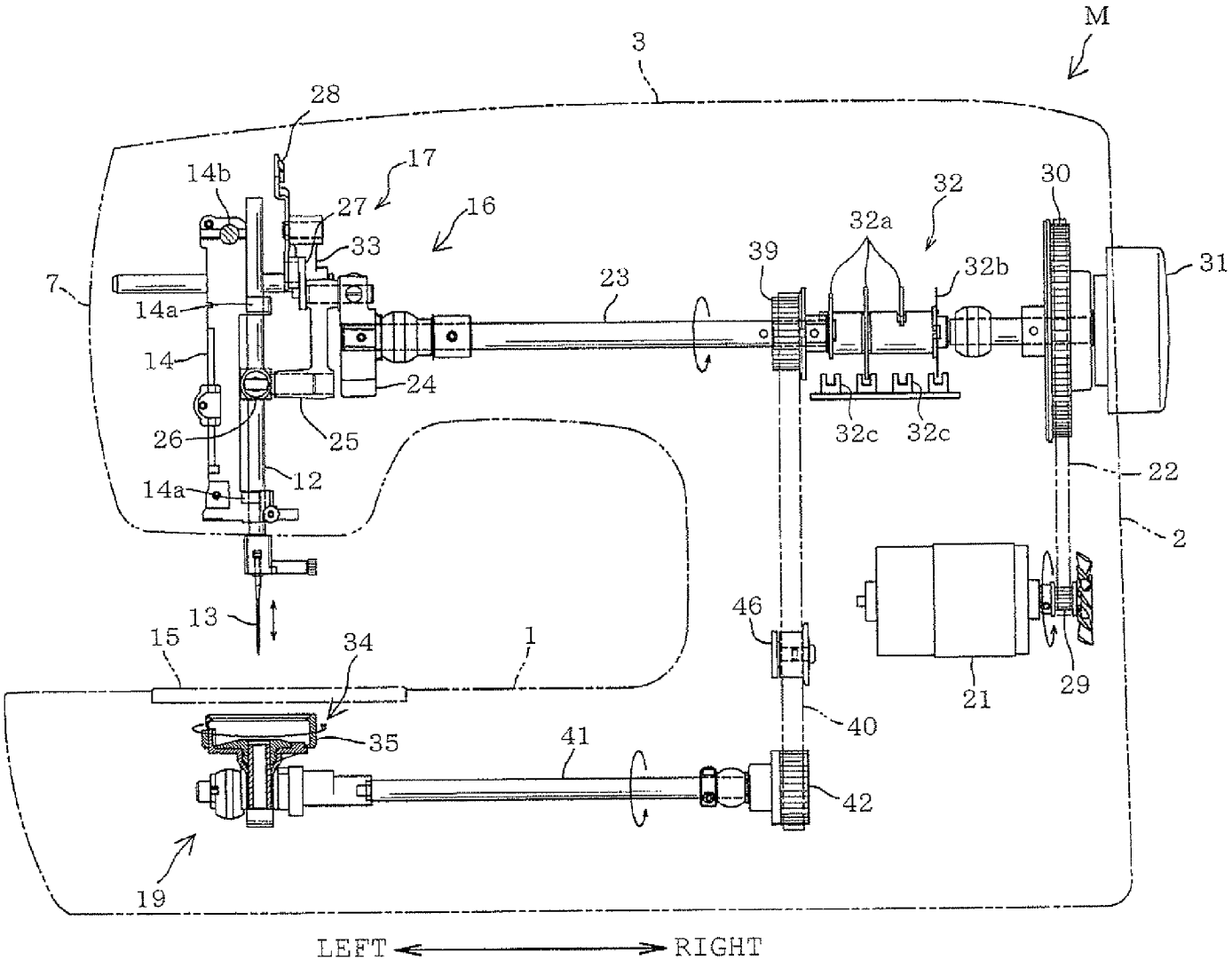
FIG. 3 is a transparent front view of important features within the sewing machine.

Referring to FIG. 3, needle bar 12 is supported by needle-bar base 14 provided within head 7. Needle-bar base 14 extends up and down in the left side proximity of needle bar 12 so as to be substantially parallel with needle bar 12. The upper end of needle-bar base 14 is rotatably supported by the sewing machine frame by way of support shaft 14*b* extending longitudinally. Needle-bar base 14 is further provided with a pair of upper and lower guides 14*a* that support needle bar 12 so as to be movable up and down. The swinging of needle-bar base 14 about support shaft 14*b* in the left and right direction causes needle bar 12 to swing in the left and right direction as well.

Figure 2:
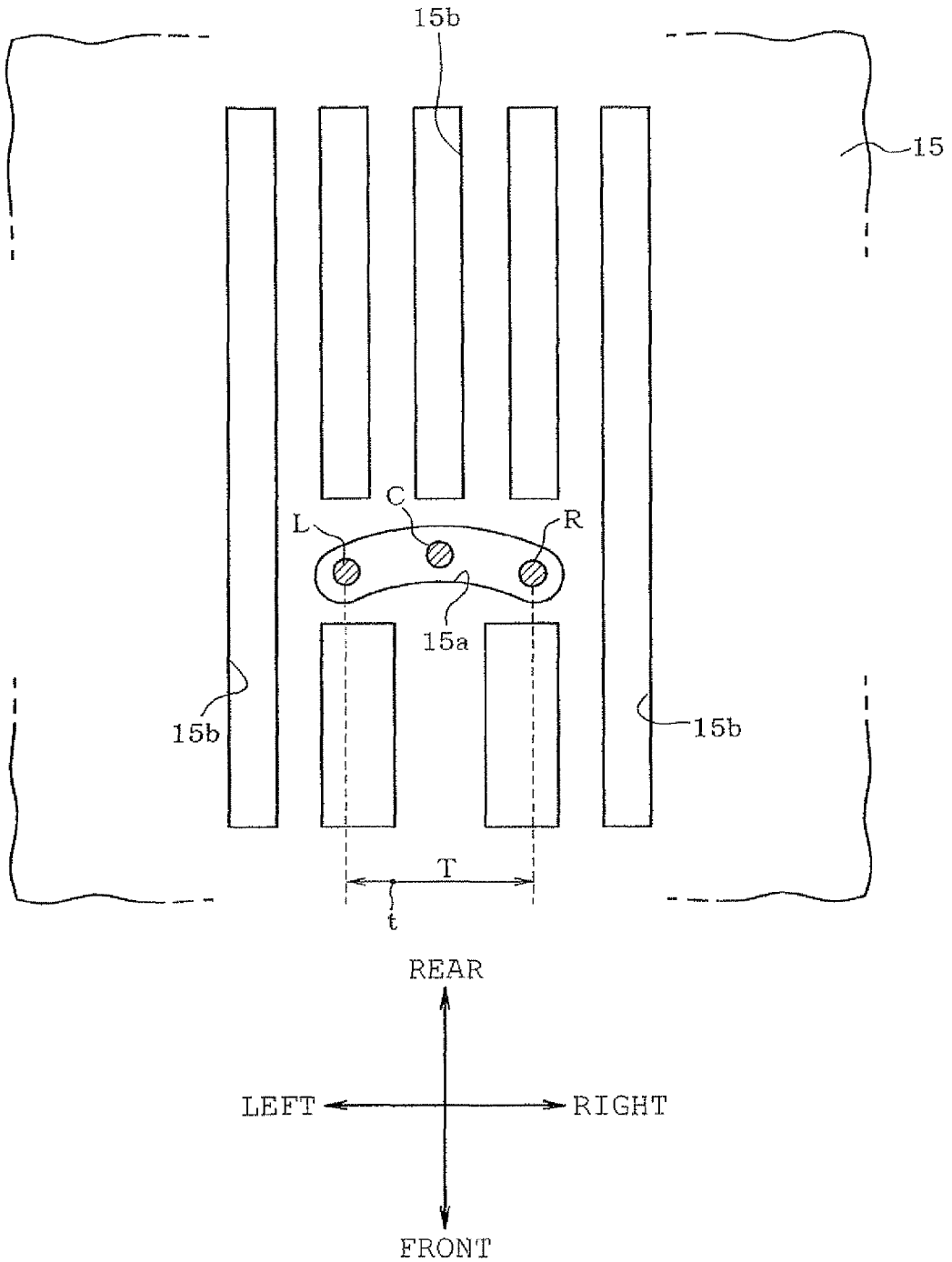
FIG. 2 is a plan view that illustrates a through hole and square holes of a needle plate.

Referring to FIG. 1, below needle bar 12, a substantially rectangular needle plate 15 is provided at bed 1. As can be seen in FIG. 2, needle plate 15 is further provided with through holes 15*a* allowing penetration of sewing needle 13 and a plurality of square holes 15*b*, 7 in the present exemplary embodiment, through which a feed dog, not shown, protrudes and retracts. The feed dog feeds workpiece cloth W shown in FIGS. 19 to 23 forward or rearward. Through hole 15*a* runs in the left and right direction to allow the left and right swinging of needle bar 12 and consequently sewing needle 13 and is slightly curved. The mechanism for swinging needle bar 12 will be later described. Each of square holes 15*b* are linearly elongated in the front and rear direction and collectively surround through hole 15*a*.

The feed dog and a feed mechanism not shown for moving the feed dog up and down and back and forth relative to needle plate 15 and consequently square holes 15*b* is situated below needle plate 15. Thread cut mechanism not shown for cutting needle thread 11 and bobbin thread not shown is also provided below needle plate 15.

Figure 7:
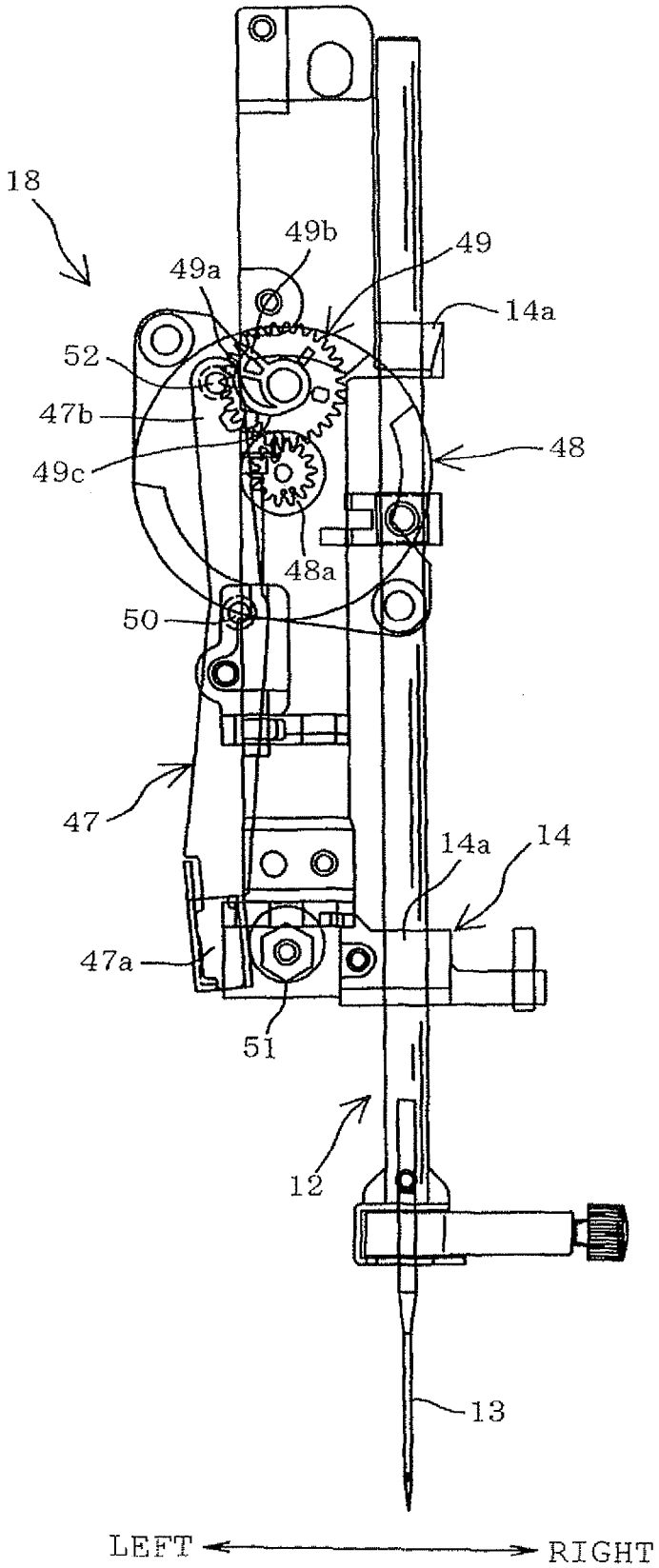
FIG. 7 is front view of a needle-bar lifting/lowering mechanism.
Figure 8:
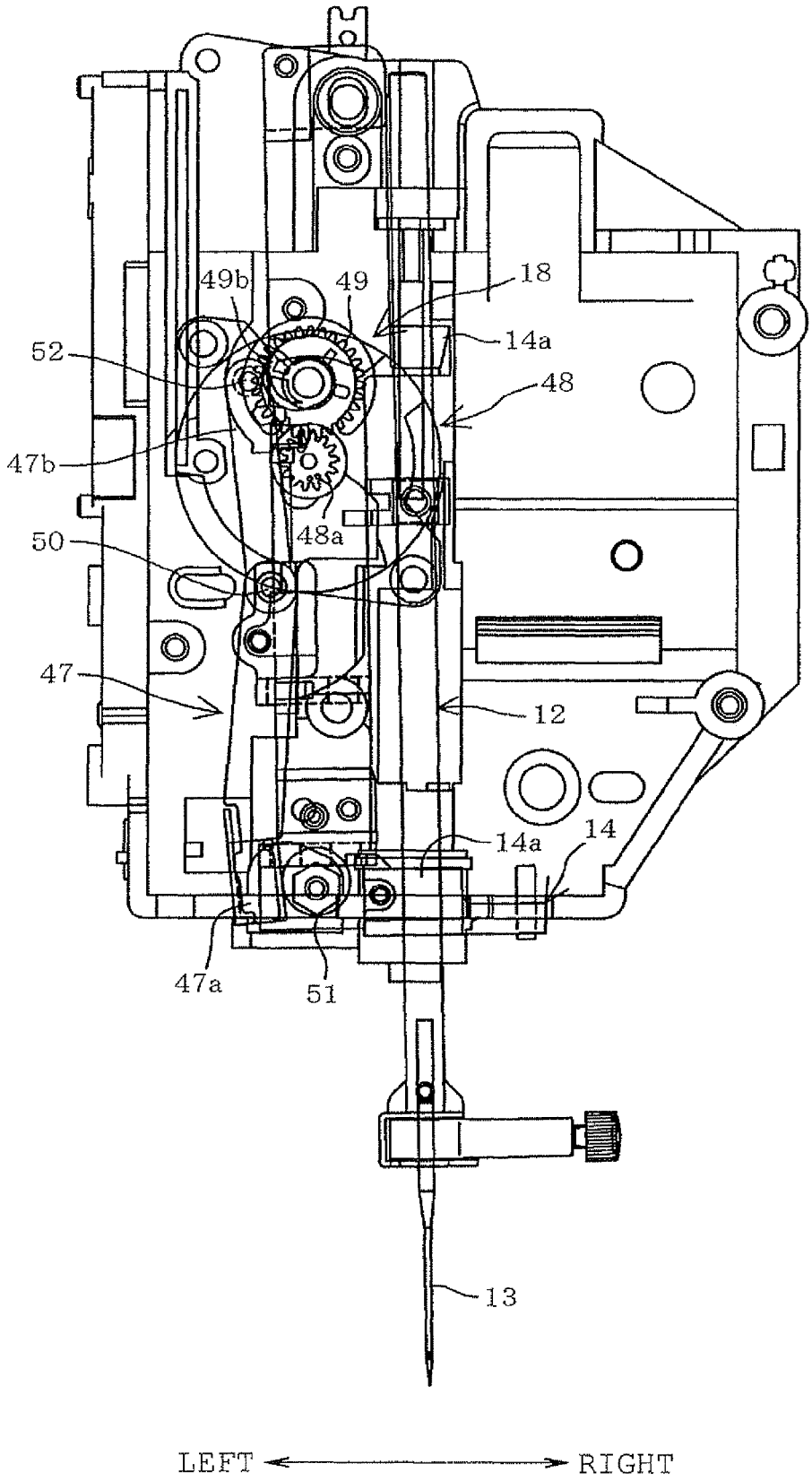
FIG. 8 is a front view of a needle-swing mechanism when the needle bar is in a right baseline position.
Figure 9:
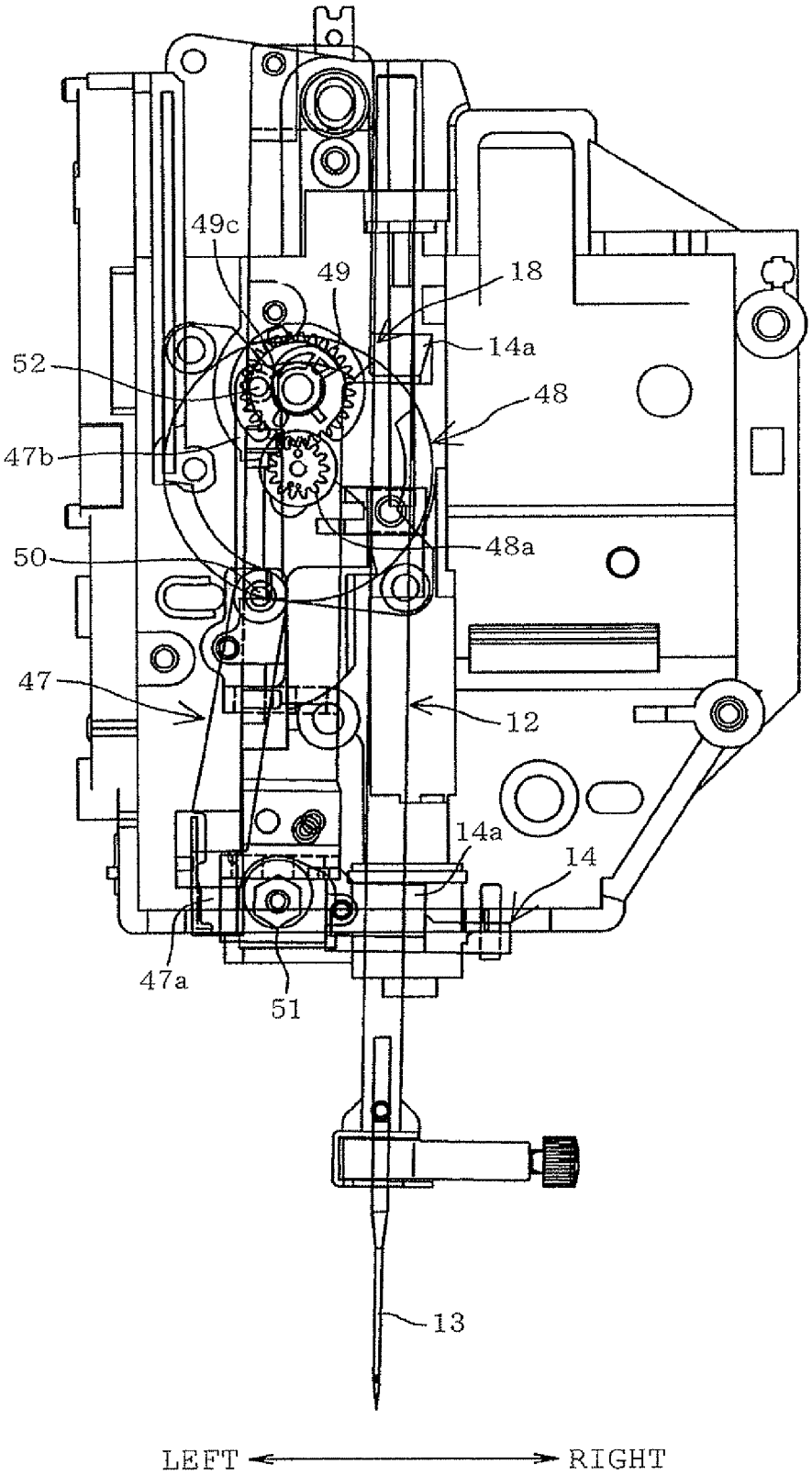
FIG. 9 is a front view of the needle-swing mechanism when the needle bar is in a left baseline position.

Sewing machine M is further provided with mechanisms such as needle-bar lifting/lowering mechanism 16 shown in FIG. 3, thread take-up lifting/lowering mechanism 17 shown in FIG. 3, needle-bar swing mechanism 18 shown in FIGS. 7 to 9, hook drive mechanism 19 shown in FIG. 3, and presser foot lifting/lowering mechanism 20 shown in FIGS. 11 to 16. The above described mechanisms will be described one by one hereinafter.

(1) Needle-Bar Lifting/Lowering Mechanism and Thread Take-Up Lifting/Lowering Mechanism Basic structures and working of needle-bar lifting/lowering mechanism 16 and thread take-up lifting/lowering mechanism 17 will be described with reference to FIG. 3. Needle-bar lifting/lowering mechanism 16 reciprocates needle bar 12 up and down whereas thread take-up lifting/lowering mechanism 17 swings thread take-up 28 up and down in synchronism with the up and down movement of needle bar 12. Needle-bar lifting/lowering mechanism 16 and thread take-up lifting/lowering mechanism 17 include components such as sewing machine motor 21, timing belt 22, upper shaft 23, and crank 24. Needle-bar lifting/lowering mechanism 16 further includes crank rod 25 and needle-bar clamp 26. Thread take-up lifting/lowering mechanism is further provided with thread take-up arm 27.

Sewing machine motor 21 is provided within pillar 2 and has an output shaft not shown having pulley 29 secured on its right end. Upper shaft 23 is rotatably supported within arm 3 by a support element not shown and extends in the left and right direction. Pulley 30 is fixed on the right side of upper shaft 23. Timing belt 22 is wound around pulley 29 and pulley 30. A manually turnable pulley 31 is fixed on the right end of upper shaft 23 so as to be exposed in the right side machine exterior. In the left side of pulley 30, rotational angle detection mechanism 32 is provided for detecting the rotational angle or the rotational phase of upper shaft 23.

Rotational angle detection mechanism 32 includes a plurality of rotational shutters 32*a*, encoder disc 32*b*, and detector 32*c* configured by a plurality of photo-interrupters. Three sectoral rotational shutters 32*a* and four photo interrupters are provided in the configuration of the present exemplary embodiment. Encoder disc 32*b* has multiplicity of fine radial slits defined on it. Rotational shutter 32*a* and encoder disc 32*b* are fixed on upper shaft 23 and rotates integrally with upper shaft 23, whereas detector 32*c* is fixed on a sewing machine frame not shown. The rotation of rotational shutter 32*a* and encoder disc 32*b* are optically sensed by the photo-interrupters of detector 32*c*. The rotational angle or the rotational phase of upper shaft 23 sensed by rotational angle detection mechanism 32 determines the height of needle bar 12.

On the left end of upper shaft 23, crank 24 is fixed that rotates integrally with upper shaft 23. Crank 24 has an eccentric portion eccentric to upper shaft 23. On the eccentric portion of crank 24, the upper end of crank rod 25 is connected rotatably by way of a rotary shaft extending in the left and right direction. Needle bar 12 has needle-bar clamp 26 fixed to it at a height between the pair of upper and lower guides 14*a* of needle-bar base 14. Needle-bar clamp 26 has a shaft not shown extending rightward and establishing rotatable connection with the lower end of crank rod 25. The lower end of crank rod 25 is connected rotatably to the shaft extending from needle-bar clamp 26 and is further configured to allow left and right swinging of needle-bar clamp 26 and consequently needle bar 12.

Eccentric portion of crank 24 is further connected to the base end of thread take-up arm 27 with the upper end of crank rod 25 interposed therebetween. From the extremity of thread take-up arm 27, distal from its base end, a shaft not shown extends leftward to establish a rotatable connection with the base end of thread take-up 28. Thread take-up 28, substantially centering on support section 33 is connected to the extremity of the support section 33 so as to be swingable about a swing shaft extending in the left and right direction. The base end of support section 33 is supported swingably to the sewing machine frame. On the extremity of thread take-up 28, a through hole not shown is provided for passing the needle thread through it.

In operation, sewing machine motor 21 rotates upper shaft 23 by way of pulley 29, timing belt 22, and pulley 30. The rotation of upper shaft 23 causes the reciprocation of needle bar 12 fixed to needle-bar clamp 26 by way of crank 24 and crank rod 25. The reciprocation of needle bar 12 causes thread take-up 29 to swing in synchronism with it. As described above, needle-bar lifting/lowering mechanism 16 converts the rotation of upper shaft 23 into the up and down reciprocation of needle bar 12 by crank 24 and crank rod 25. The rotation of upper shaft 23 and the up and down reciprocation of needle bar 12 take on a 1 on 1 relation, meaning that as upper shaft 23 is rotated once, needle bar 12 is reciprocated once to cause thread take-up 28 to swing up and down once.

(2) Hook Drive Mechanism

Figure 4:
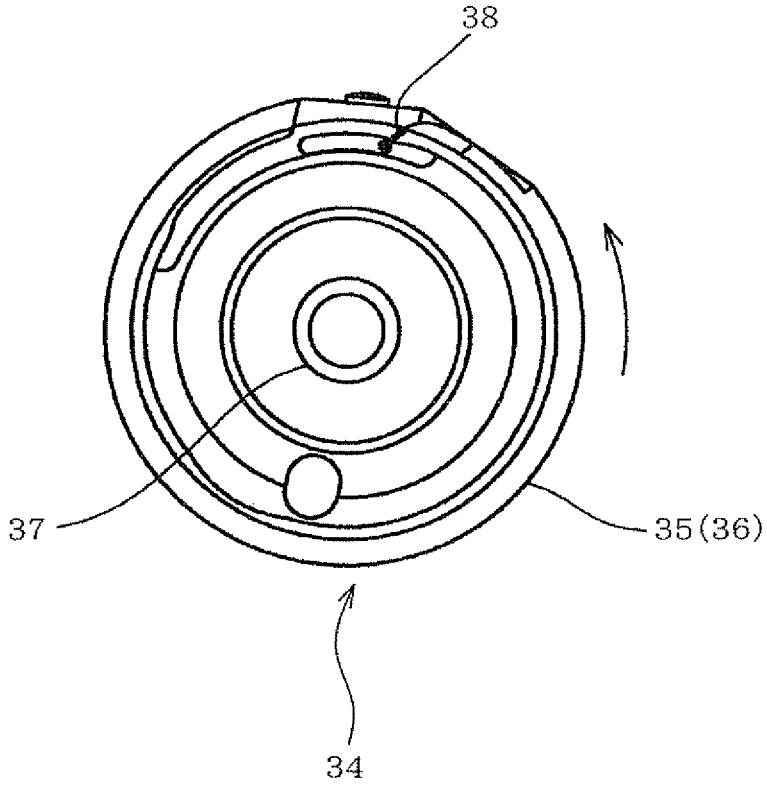
FIG. 4 is a plan view of a horizontal rotary hook.

Next, basic structures and working of hook drive mechanism 19 is described with reference to FIGS. 3 to 6. Hook mechanism 19 rotates horizontal rotary hook 34 in detachable attachment with a bobbin not shown in synchronism with the rotation of upper shaft 23. As known to those of ordinary skill in the art, bobbin is wound with bobbin thread which is interlaced with the needle thread to form a seam. Horizontal rotary hook 34 is provided within bed 1 below needle plate 15 and is provided with outer hook 35 and an inner hook not shown that houses the bobbin. As can be seen in FIG. 4, outer hook 35 includes outer hook body 36, hook sleeve 37 fixed to outer hook body 36 and extending vertically downward, and a hook shaft not shown being inserted into hook sleeve 37 to rotatably support outer hook body 36. Beak 38 mentioned earlier is provided on outer hook body 36 and has a sharpened tip extending along the perimeter of outer hook body 36. Beak 38 seizes needle thread loop 11*a* shown in FIGS. 19 to 23 that is formed at needle eye 13*b* of sewing needle 13. Needle thread loop, as described earlier, is a small loop formed by needle thread 11 running between needle eye 13*b* and workpiece cloth W.

Figure 5:
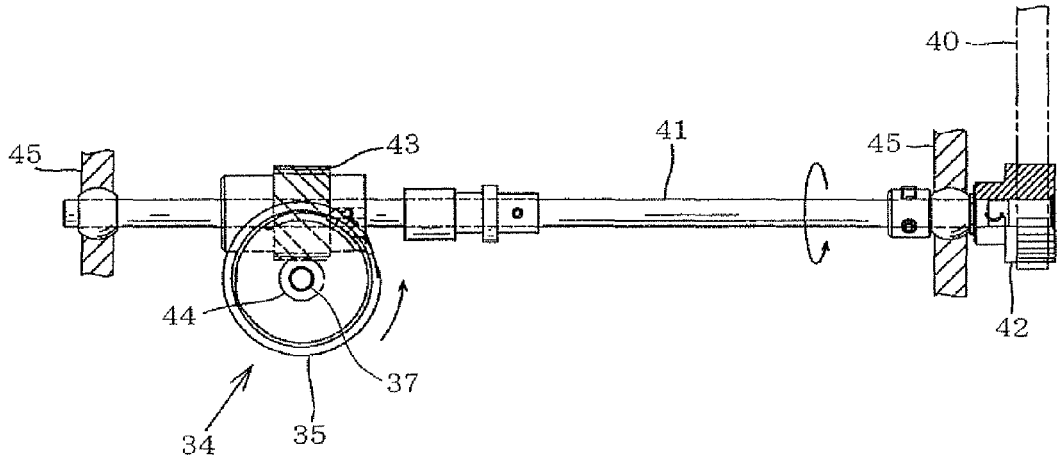
FIG. 5 is a plan view of a lower shaft, the horizontal rotary hook and their peripheral structures.
Figure 6:
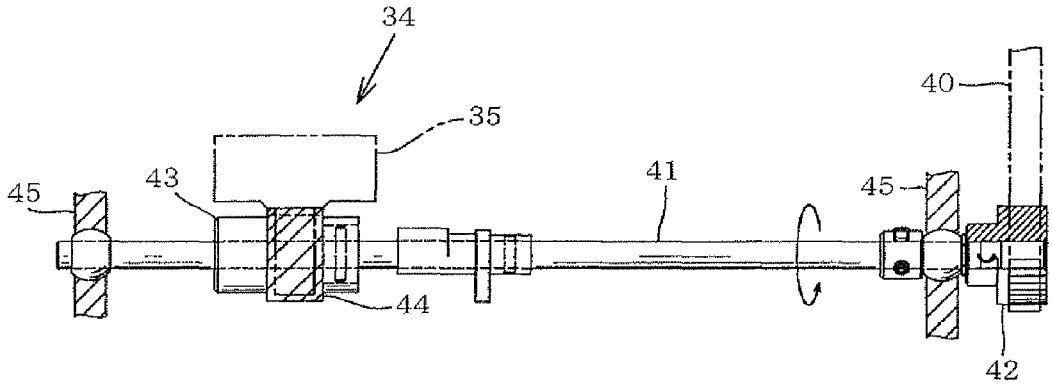
FIG. 6 is a front view of a lower shaft, the horizontal rotary hook and their peripheral structures.

Outer hook body 36 is connected to hook drive mechanism 19 by way of hook sleeve 37. As can be seen in FIG. 3, hook drive mechanism 19 includes components such as a pulley 39, timing belt 40, lower shaft 41, pulley 42, lower gear 43, and hook gear 44. Pulley 39 is provided on the left side of rotational angle detection mechanism 32 of upper shaft 23 and is rotated integrally therewith, whereas pulley 42 is provided on the right end of lower shaft 41 and is rotated integrally therewith. Lower shaft gear 43 is attached to the left end of lower shaft 41 as shown in FIGS. 5 and 6. Hook gear 44 is fixed to hook sleeve 37 as shown in FIGS. 5 and 6.

Lower shaft 41 is disposed in the left and right direction within bed 1 and is supported rotatably by support section 45 shown in FIGS. 5 and 6. Timing belt 40 is wound around pulley 39 and pulley 42. Timing belt 40 is also wound around tensioner pulley 46 which imparts appropriate tension to timing belt 40.

In operation, when sewing machine motor 21 rotates upper shaft 23, lower shaft 41 is rotated by way of pulley 39, timing belt 40, and pulley 42. The rotation of upper shaft 23 and the rotation of lower shaft 41 take on a 1 on 1 relation, meaning that as upper shaft 23 is rotated once, lower shaft 41 is rotated once to cause thread take-up 28 to swing up and down once.

As can be seen in FIGS. 5 and 6, lower shaft gear 43 is configured by a helical gear twisted to the right. As mentioned earlier, lower shaft gear 43 is rotated integrally with lower shaft 41. Hook gear 44 is also configured by a helical gear twisted to the right. Hook gear 44 is fixed to gear hook sleeve 37 and is rotated integrally with hook sleeve 37. Lower shaft gear 43 and a hook gear 44 are meshed such that their axes are mutually orthogonal. The rotation of lower shaft 41 is thus, transmitted to hook sleeve 37.

Lower shaft 41 driven in rotation by sewing machine motor 21 causes rotation of lower shaft gear 43 which in turn causes hook gear 44 being meshed with lower gear shaft 43 to rotates to thereby rotate outer hook 35. The gear ratio between lower shaft gear 43 and hook gear 44 is set such that outer hook 35 rotates twice while lower shaft 41 rotates once.

Hook drive mechanism 19 rotates lower shaft 41 to rotate outer hook counterclockwise as viewed in the plan view of FIG. 4. Upper shaft 23 and lower shaft 41 are synchronized in a one to one relation and thus, outer hook 35 is synchronized with the up and down movement of needle bar 12. Hence, the counterclockwise rotation of outer hook 35 during the sewing operation causes beak 38 provided on outer hook 35 to seize loop 11*a* shown in FIGS. 19 to 23 of needle thread 11 formed at eye 13*b* of sewing needle 13.

(3) Needle-Bar Swing Mechanism

Next, basic structures and working of needle-bar swing mechanism 18 is described with reference to FIGS. 7 to 9. Needle-swing mechanism 18 swings needle bar 12 in a direction orthogonal to the direction in which workpiece cloth is fed, meaning that, for instance, if workpiece cloth is fed in the front and rear direction of sewing machine M, the needle bar 12 is swung in the left and right direction of sewing machine M. As can be seen in FIGS. 7 and 9, needle-bar swing mechanism 18 is further configured by components such as swing lever 47, needle-bar swing pulse motor 48 and swing cam 49.

Swing lever 47 extends in the up and down direction so as to be substantially parallel to needle-bar base 14. At mid length, swing lever 47 is pivoted about pivot pin 50 extending in the front and rear direction from sewing machine frame. Lower end 47*a* of swing lever 47 abuts cam 51 secured at the lower end of needle-bar base 14, whereas upper end 47*b* of swing lever 47 has pin 52 fixed to it that abuts swing cam 49. Pin 52 extends in the front and rear direction and is placed in abutment with cam surface 49*a* defined on swing cam 49 which acts to impart left and right swinging of needle-bar base 14.

The lower end of needle-bar base 14 is biased leftward by coil spring not shown to maintain the abutment of lower end 47*a* of swing lever 47 and cam 51 and the abutment of pin 52 and cam surface 49*a* of swing cam 49. Swing cam 49 is supported rotatably by the sewing machine frame. Swing cam 49 is a geared cam and the gear formed on its outer perimeter is meshed with drive gear 48*a* of pulse motor 48 affixed to the sewing machine frame. Swing cam 49 is thus, driven by pulse motor 48. Cam surface 49*a* of swing cam 49 comprises large radius cam surface 49*b* and small-radius cam surface 49*c* which is located closer to the axis of rotation of swing cam 49 as compared to large-radius cam surface 49*b*. Large radius cam surface 49*b* and small-radius cam surface 49*c* are continuous with cam surface 49*a*.

As shown in FIG. 8, as swing cam 49 is driven in rotation by pulse motor 48 and pin 52 is placed in abutment with large-radius cam surface 49*b* which is relatively distant from the axis of rotation of swing cam 49, pin 52 is pushed leftward by large-radius cam surface 49*b* to cause upper end 47*b* of swing lever 47 to move leftward. Responsively, swing lever 47 rotates counterclockwise about pivot pin 50 as viewed in FIG. 8 to move lower end 47*a* of swing lever 47 rightward. The rightward movement of lower end 47*a* of swing lever pushes cam 51 rightward to move needle-bar base 14 rightward against the bias of coil spring. Thus, needle-bar swing mechanism 18 swings needle bar 12 rightward toward right baseline position R indicated in FIG. 2.

As shown in FIG. 9, as swing cam 49 is driven in rotation by pulse motor 48 and pin 52 is placed in abutment with small-radius cam surface 49*c* which is relatively proximal to the axis of rotation of swing cam 49, pin 52 is pushed leftward by the bias of coil spring which is responsible for the leftward bias applied on needle-bar base 14. Lower end 47*a* of swing lever 47 is thus, moved leftward by being pushed by cam 51 to cause upper end 47*b* of swing lever 47 to move rightward. Responsively, swing lever 47 rotates clockwise about pivot pin 50 as viewed in FIG. 9 to move lower end 47*a* of swing lever 47 leftward by the bias of the coil spring and consequently move needle-bar base 14 leftward. Needle-bar swing mechanism 18 swings needle bar 12 leftward toward left baseline position L indicated in FIG. 2.

As described above, needle-bar swing mechanism 18 swings needle bar 12 and consequently sewing needle 13 between a first swing position identified as right baseline position R and a second swing position identified as left baseline position L in FIG. 2, respectively based on the rotation amount of pulse motor 48 which may be sensed as the count of outputted pulse of pulse motor 48. Spacing T between right baseline position R and left baseline position L represents swing width of needle bar 12 and is set approximately at 9 mm in the present exemplary embodiment. The midpoint between right baseline position R and left baseline position L is identified as mid baseline position C in FIG. 2.

Lateral swinging of needle bar 12 by needle-bar swing mechanism 18 gives sewing machine M the capacity to sew various patterns such as zigzag patterns. Sewing machine M sews patterns with straight stitches by moving needle bar 12 to mid baseline position C and moving needle bar 12 up and down while maintaining mid baseline position C. Similarly, sewing machine M is capable of sewing patterns with straight stitches by keeping needle bar 12 to left baseline position L or right baseline position R and reciprocating needle bar 12 up and down.

Figure 10:
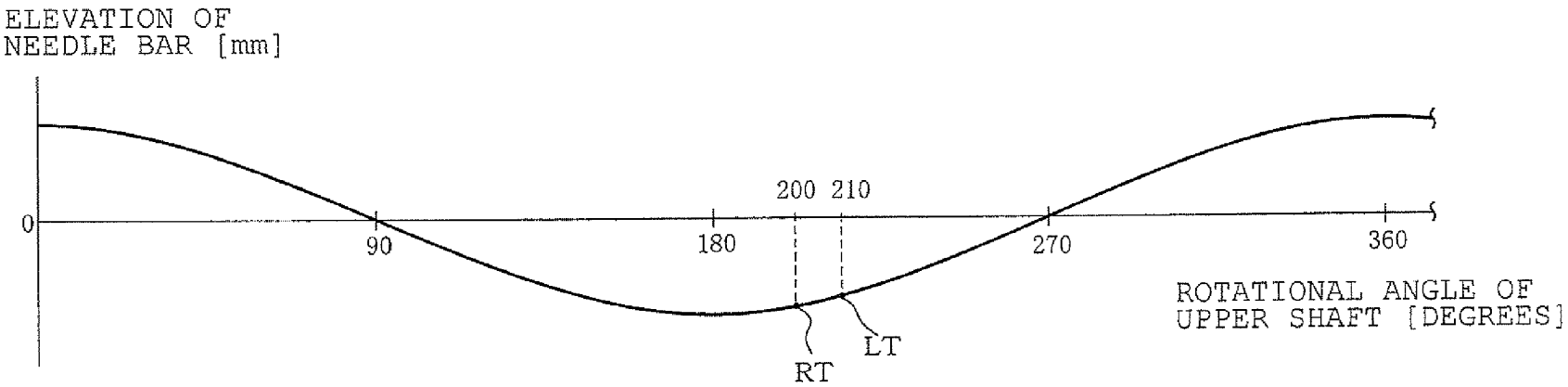
FIG. 10 is a chart showing relation between rotational angle of upper shaft and height of needle bar.

Next, the relation between the height of needle bar 12, the lateral positions of needle bar 12, and the timing in which beak 38 meets sewing needle 13 will be discussed hereinafter. As described earlier, beak 38 seizes needle thread loop 11*a* at the timing when it meets sewing needle 13. FIG. 10 is a chart indicating the correlation between height of needle bar 12 and rotational angle of upper shaft 23.

As can be seen from FIG. 10, upper shaft 23 rotates 360 degrees while needle bar 12 moves up and down once. When needle bar 12 is at right baseline position R, beak 38 meets loop 11*a* of needle thread 11 to seize needle thread loop 11*a* at right side timing RT in which state outer hook body 36 is at a first rotational position. The rotational angle of upper shaft 23 at right side timing RT is approximately 200 degrees. When needle bar 12 is at left baseline position L, on the other hand, beak 38 meets loop 11*a* of needle thread 11 to seize needle thread loop 11*a* at left side timing LT in which state outer hook body 36 is at a second rotational position. The rotational angle of upper shaft 23 at left side timing LT is approximately 210 degrees.

Outer hook body 36 and consequently beak 38 provided at outer hook body 36 rotates twice while upper shaft 23 rotates once, in other words, while needle bar 12 is moved up and down once. In the first rotation, beak 38 does not seize needle thread loop 11*a* and workpiece cloth W is fed by a single stitch pitch. Beak 38 seizes needle thread loop 11*a* in the second rotation.

(4) Presser Foot Lifting/Lowering Mechanism

Figure 11:
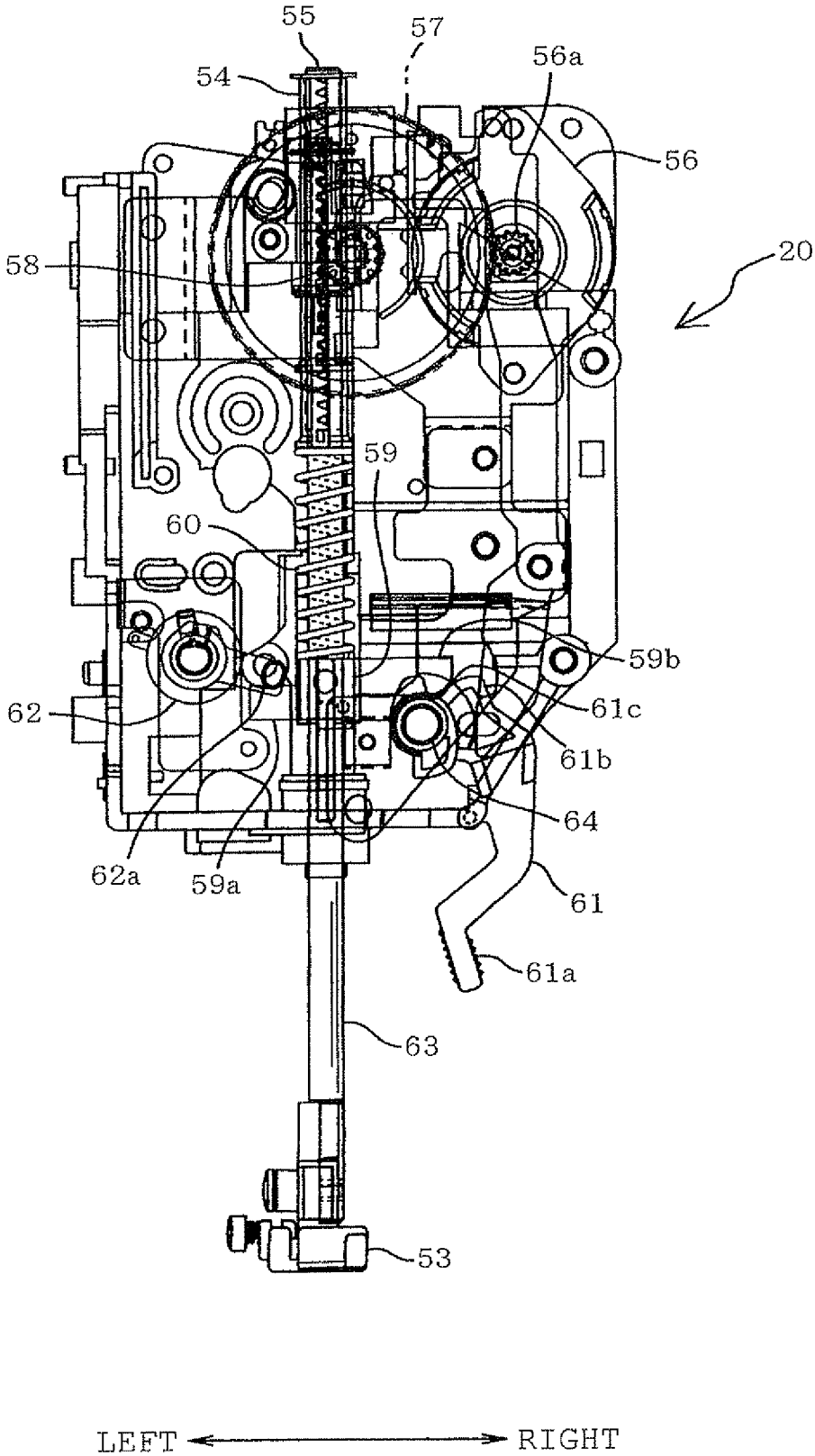
FIG. 11 is a partially transparent front view of the needle-bar lifting/lowering mechanism.
Figure 12:
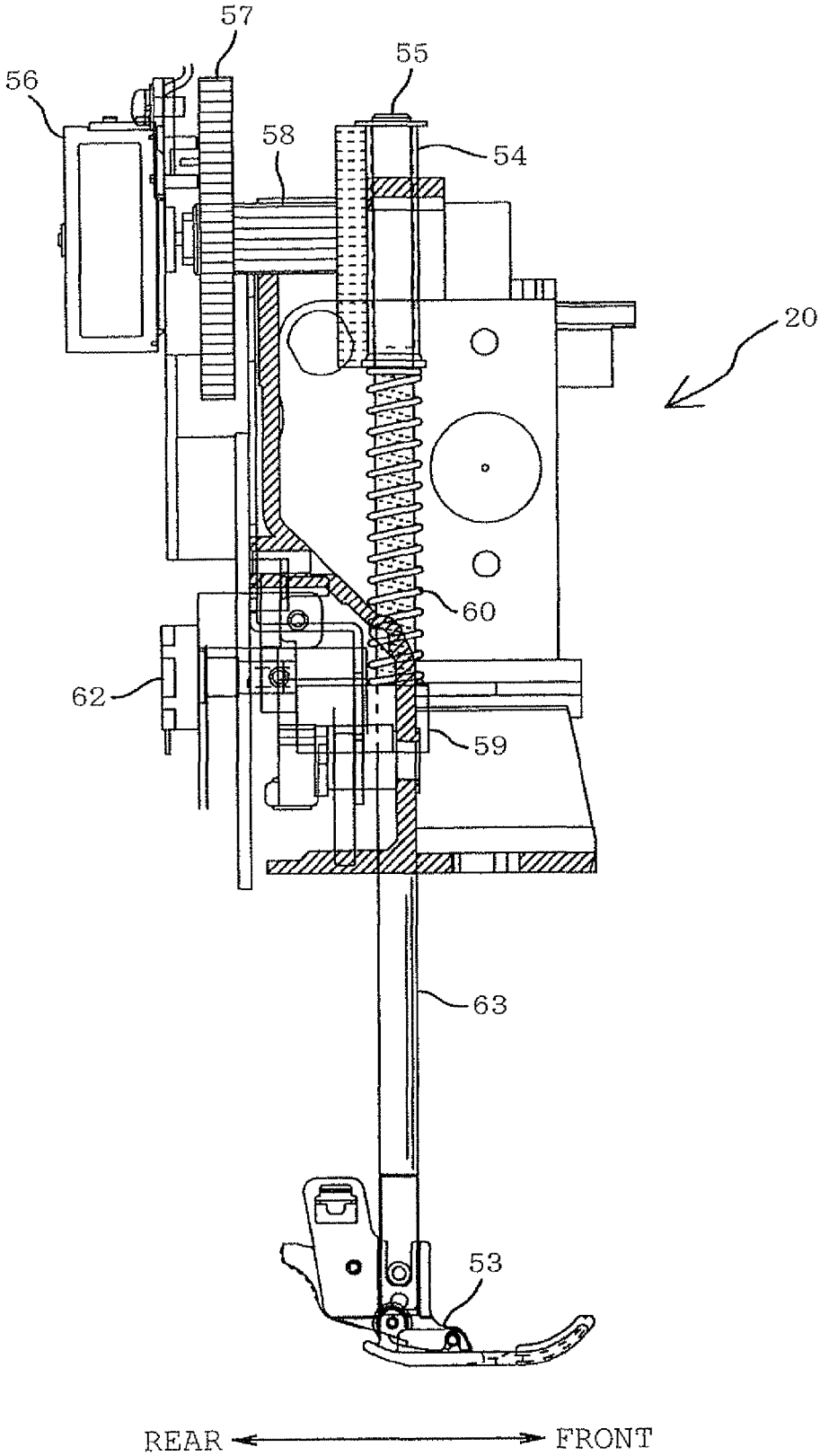
FIG. 12 is a partially transparent left side view of the needle-bar lifting/lowering mechanism.
Figure 13:
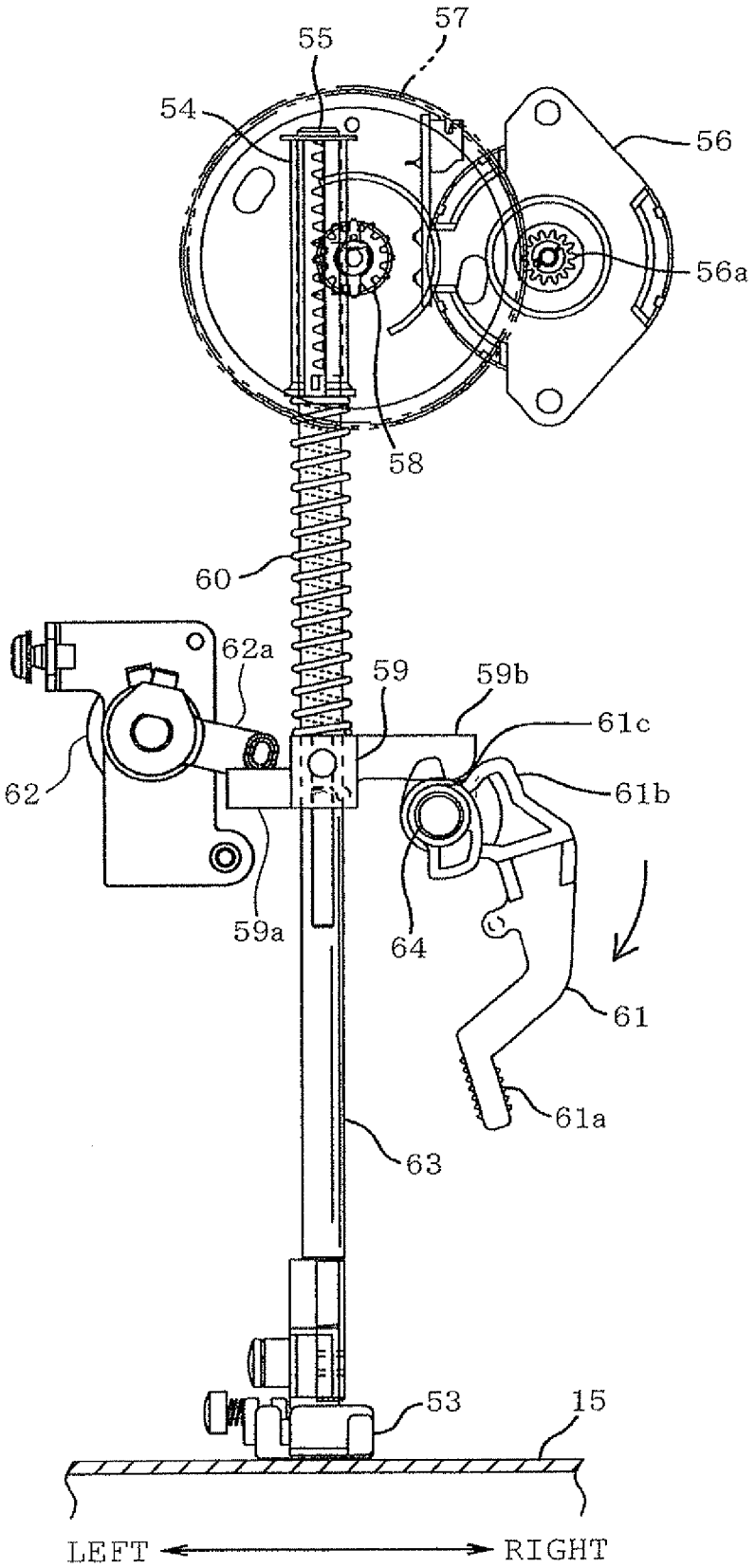
FIG. 13 is a front view of the needle-bar lifting/lowering mechanism and illustrates the behavior of important features of the needle-bar lifting/lowering mechanism when a presser foot lifting lever is in a descended position.

Next, basic configuration and working of presser foot lifting/lowering mechanism 20 will be described with reference to FIGS. 11 to 16. Presser foot lifting/lowering mechanism 20 reciprocates presser foot 53 attached on the lower end of presser bar 63 up and down. As shown in FIGS. 11 and 12, presser foot lifting/lowering mechanism 20 is disposed behind needle bar 12. Presser foot lifting/lowering mechanism 20 is configured by components such as needle bar 63, presser foot 53, rack forming element 54, stop ring 55, pulse motor 56, drive gear 56*a*, intermediate gear 57, pinion 58, presser-bar clamp 59, presser spring 60, presser foot lifting lever 61, and potentiometer 62.

Presser bar 63 is movably supported by the sewing machine frame so that it can be lifted/lowered. Presser foot 53 is detachably and interchangeably attached to the lower end of presser bar 63. Rack forming element 54 is provided at the upper end of presser bar 63 so that it can be lifted/lowered. Stop ring 55 is affixed to the upper end of presser bar 63. Pulse motor 56 drives the lifting/lowering presser bar 63 and is secured on the sewing machine frame immediately to the right of rack forming element 54. On the output shaft of pulse motor 56, drive gear 56*a* is affixed which is driven in rotation integrally with the output shaft. Drive gear 56*a* is meshed with intermediate gear 57 which rotates with drive gear 56*a*. Intermediate gear 57 has pinion 58 formed integrally with it that is meshed with rack forming element 54.

Presser bar clamp 59 is affixed at mid height of presser bar 63 and between presser bar clamp 59 and rack forming element 54 of presser bar 63, presser spring 60 is further provided. Presser bar 63 being lifted/lowered by pulse motor 56 can also be lifted/lowered by user manual operation of presser foot lifting lever 61 independent of lifting/lowering by pulse motor 56. Presser foot lifting lever 61 is biased clockwise in front view by a coil spring not shown provided with it.

At the left side of presser bar 53, a rotary potentiometer 62 is provided for sensing the height of presser bar 63 based on the resistance that varies with its amount of rotation. Potentiometer 62 has pinion 58 provided integrally with it which is meshed with rack forming element 54. Potentiometer 62 also has lever 62*a* that extends rightward from its rotary shaft which is biased, for instance, by a coil spring not shown so as to be placed in abutment with the upper surface side of protrusion 59*a* protruding leftward from presser bar clamp 59.

Thus, lever 62*a* rotates with the lifting/lowering of presser bar clamp 59 and resistance of potentiometer varies with the rotational angle of lever 62*a*. Based on the voltage obtained from the resistance, a later described controller 65 senses the height of presser bar 63 and consequently presser foot 53. Controller 65 specifies the resistance of potentiometer 62 when presser foot 53 is in a position to contact the upper surface of needle plate 15 as a reference value for sensing the thickness of workpiece cloth W. By comparing the reference value with the resistance of potentiometer 62, controller 65 is capable of sensing the height of presser foot 53, in other words, the thickness of workpiece cloth W.

One end of presser foot lifting lever 61 is pivoted about pivot pin 64 affixed to sewing machine frame. The other end of presser foot lifting lever 61 is provided with handle 61*a* for manual operation by the user. Presser foot lifting lever 61 is turned between the descended position shown in FIG. 13 and the lifted position shown in FIG. 14. The turning or the rotation of presser foot lifting lever 61 lifts/lowers presser bar 63 and consequently the presser foot 53 attached to it.

Presser foot lifting lever 61 has cam surface 61*b* that is placed in abutment with cam follower 59*b* provided integrally with presser bar clamp 59. At the descended position shown in FIG. 13, there is a small vertical clearance between boss surface 61*c* and cam follower 59*b* of presser foot lifting lever 61. At the lower position, presser foot 53 is placed in contact with needle plate 15. In the upper position shown in FIG. 14, cam surface 61*b* and cam follower 59*b* of presser foot lifting lever 61 are placed in contact so as to close the clearance. At the upper position, presser bar 63 is lifted above needle plate 15. When in the upper position, pulse motor 56 is excited but prohibited from rotation and thus, rack forming element 54 maintains its height in which state presser spring 60 is compressed. The elasticity of the compressed presser spring 60 causes cam follower 59*b* to be pressed against cam surface 61*b*. The pressure exerts counterclockwise momentum to presser foot lifting lever 61 to consequently maintain the lifted position.

According to the above described construction, presser foot 53 may be lifted/lowered by manual operation of presser foot lifting lever 61. By turning presser foot lifting lever 61 upward to the lifted position, presser foot 53 can be lifted to the upper position shown in FIG. 14, whereas by turning presser foot lifting lever 61 downward to the descended position, presser foot 53 can be lowered to the lowermost position shown in FIG. 13.

Next, lifting/lowering movement of presser bar 63 driven by pulse motor 56 will be described with reference to FIGS. 15 and 16.

Pulse motor 56, when driven, transmits its drive force to intermediate gear 57 and pinion 58 to lift/lower rack forming element 54.

Figure 14:
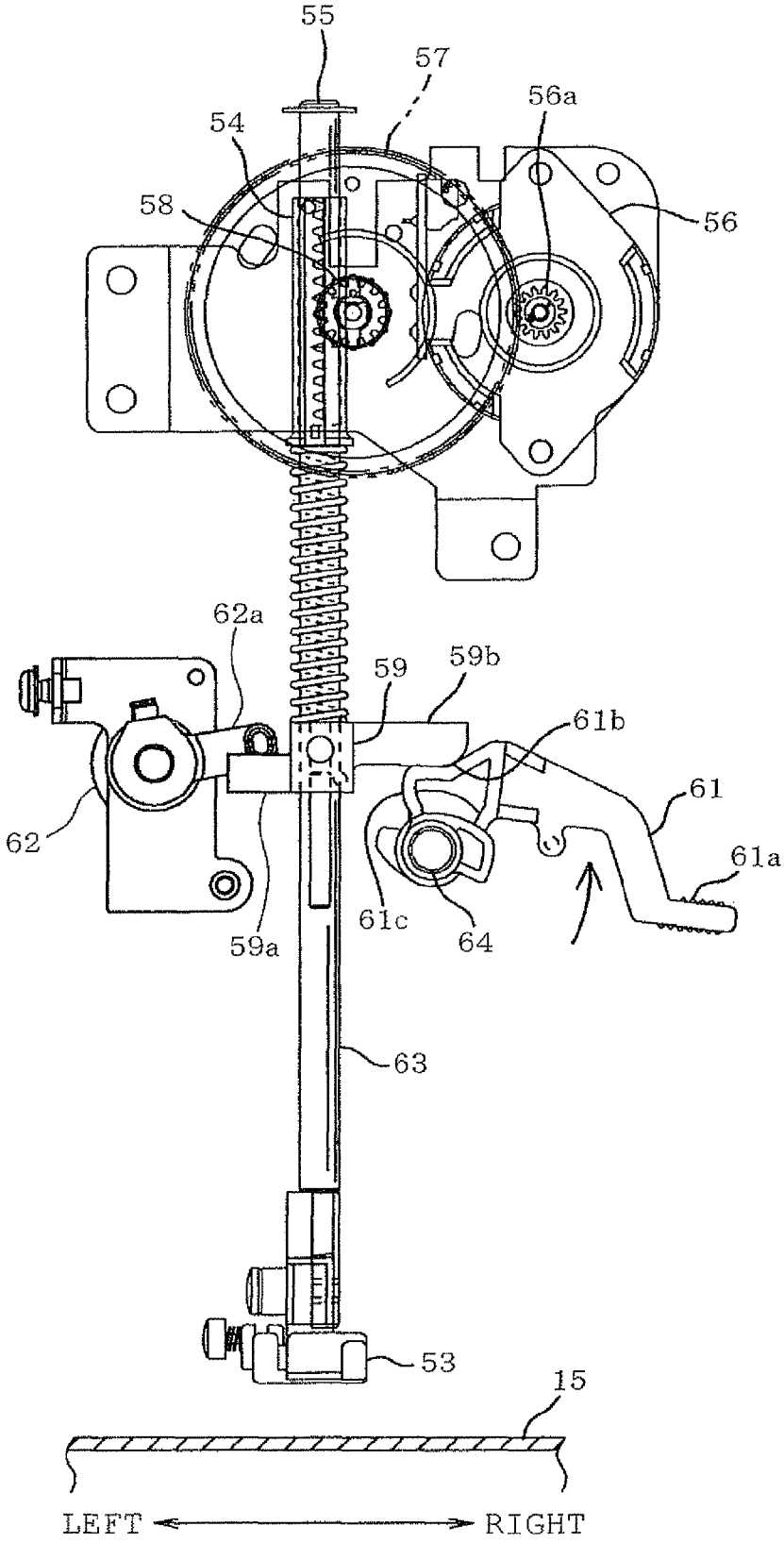
FIG. 14 is a front view of the needle-bar lifting/lowering mechanism and illustrates the behavior of important features of the needle-bar lifting/lowering mechanism when the presser foot lifting lever is in a lifted position.
Figure 15:
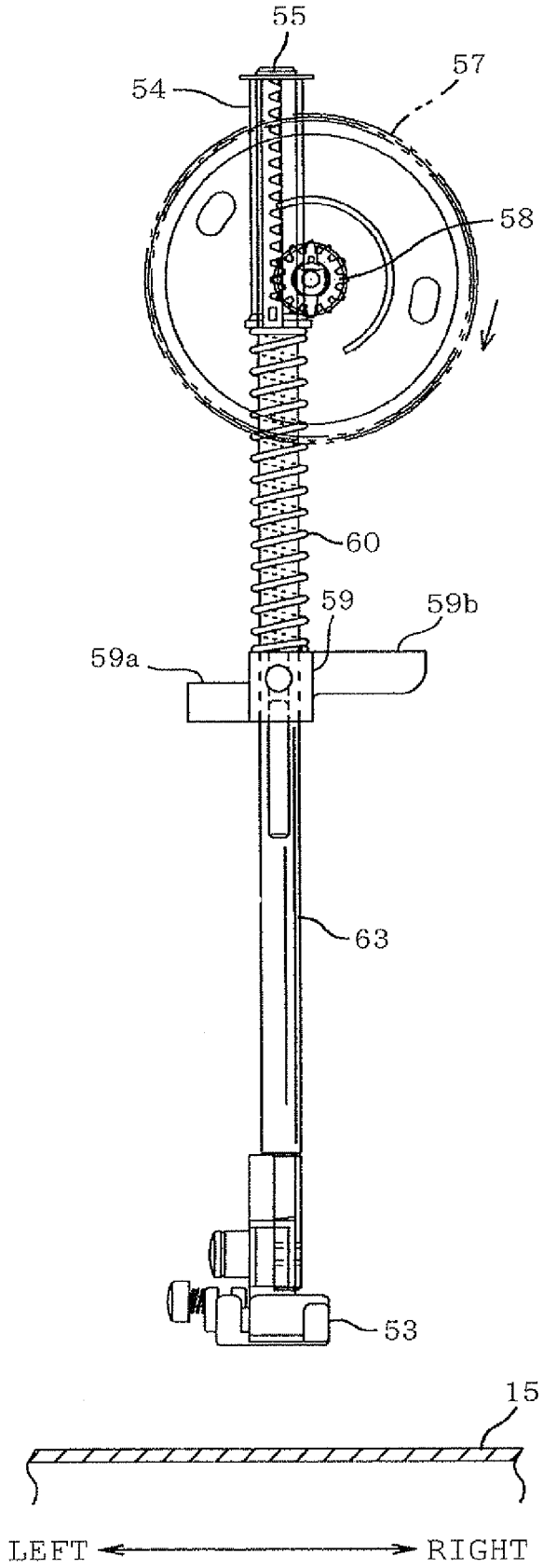
FIG. 15 is a front view of the needle-bar lifting/lowering mechanism and illustrates the behavior of important features of the needle-bar lifting/lowering mechanism when a presser foot is in an uppermost position.
Figure 16:
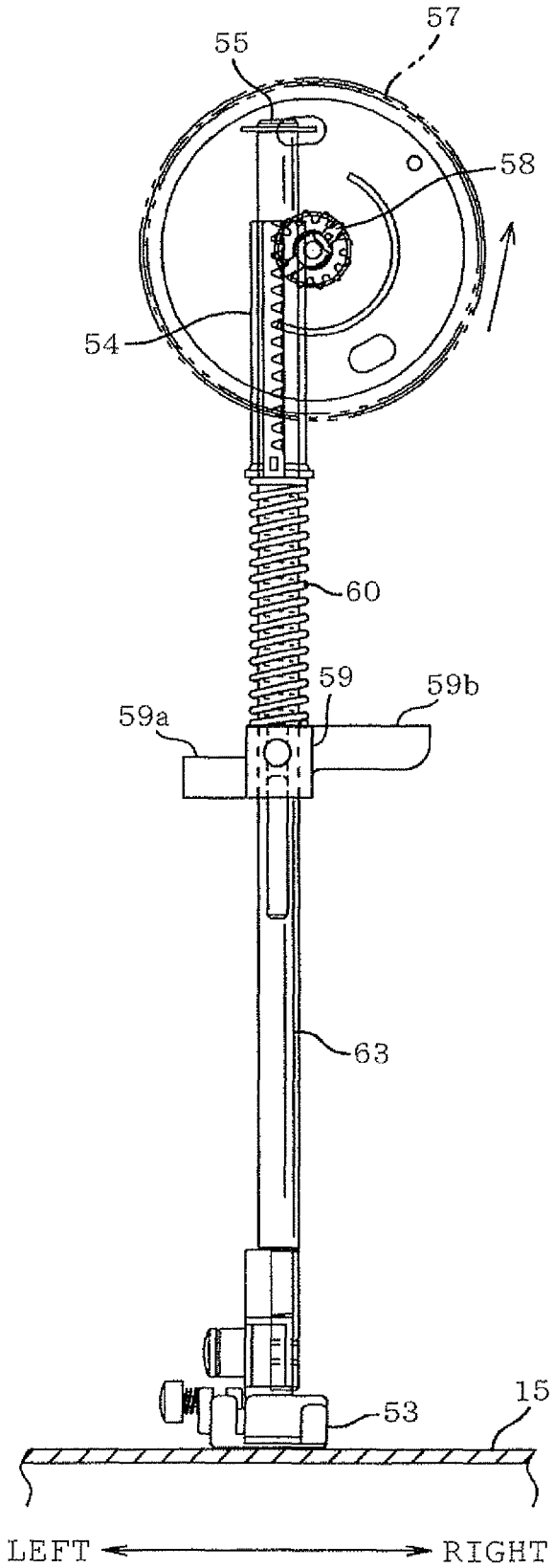
FIG. 16 is a front view of the needle-bar lifting/lowering mechanism and illustrates the behavior of important features of the needle-bar lifting/lowering mechanism when the presser foot is in a lowermost position.

In lifting presser bar 63, rack forming element 54 is lifted by being driven by pulse motor 56 to cause its upper end surface to lift stop ring 55 secured at the top of presser bar 63 to consequently lift presser foot 53 as shown in FIG. 15. The position of presser foot 53 shown in FIG. 15 is higher than the upper position shown in FIG. 14 rendered by manual operation of presser foot lifting lever 61 and thus, is identified as the uppermost position.

In lowering presser bar 63 from the uppermost position shown in FIG. 15, rack forming element 54 is lowered by being driven by pulse motor 56 to cause its lower end surface to press presser spring 60 downward to consequently lower presser foot 53 to the lowermost position as shown in FIG. 15 where it is placed in contact with needle plate 15.

Presser foot 53 once lifted to the upper position shown in FIG. 14 by the manual operation of presser foot lifting lever 61 may be further lifted to the uppermost position shown in FIG. 15 by driving rack forming member 54 upward by pulse motor 56. As pulse motor 56 is driven from the state shown in FIG. 14, cam surface 61*b* of presser foot lifting lever 61 and cam follower 59*b* become disengaged or separated to cause the clockwise biased presser foot lifting lever 61 to be turned to the descended position shown in FIG. 13. The presser foot 53 thus being placed in the uppermost position can be similarly lowered to the lowermost position by lowering rack forming member 54 by driving pulse motor 56.

The press position or the lower position of presser foot 53 which comes between the uppermost position and the lowermost position may be specified based on parameters such as the thickness of workpiece cloth W and be stored in RAM 68 as an intermediate position. Under such configuration, presser foot 53 can be driven, by pulse motor 56, to the press position suitable for the thickness of workpiece cloth based on the specified intermediate position. In operation, pulse motor 56 is driven based on the thickness of workpiece cloth W sensed by potentiometer 62 and is stopped once presser foot 53 or presser bar 63 reaches the specified press position.

The pressure applied on workpiece cloth W by presser foot 53 is determined based on the press position of presser foot 53 and further by the thickness of workpiece cloth W which is being pressed by presser foot 53. Stated differently, if the press position of presser foot 53 is constant, pressure exerted by presser foot 53 increases as workpiece cloth W becomes thicker, and pressure exerted by presser foot 53 decreases as workpiece cloth W becomes thinner. In summary, the pressure exerted by presser foot 53 may vary depending upon the thickness of workpiece cloth W even under the same press position.

Figure 17:
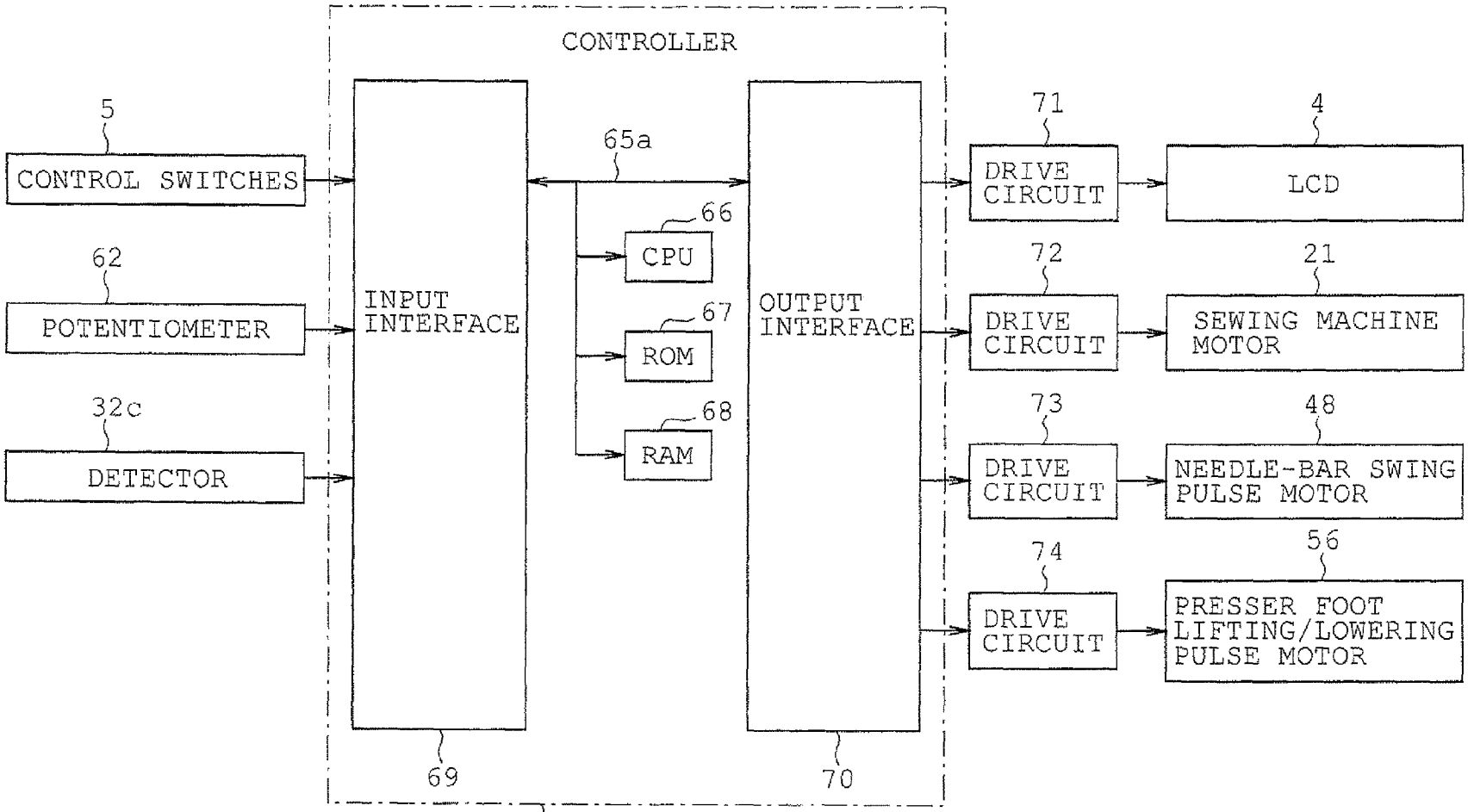
FIG. 17 is a block diagram indicating a control system of the sewing machine.

Next, the control system of sewing machine M will be described with reference to FIG. 17.

Controller 65 is responsible for the overall control of sewing machine M. Controller 65 comprises: a microcomputer primarily configured by CPU 66, ROM 67, and RAM 68; input interface 69; and output interface 70. CPU 66, ROM 67, RAM 68, input interface 70, and output interface 70 are interconnected by data bus 65*a*. Input interface 69 establishes electrical connection with various components such as operation switches 5, sensors 32*c*, and potentiometer 62. Output interface 70 establishes electrical connection with components such as liquid crystal display 4 hereinafter also described as LCD 4, sewing machine motor 21, pulse motor 48, and pulse motor 56 by way of drive circuits 71 to 74.

ROM 67 stores various control programs for controlling the operation of sewing machine M. The control program is a collection of programs such as a sew control program for controlled execution of a sewing operation, a display control program for displaying various information on LCD 4, and a drive control program for controlling motor drive of motors such as a sewing machine motor 21, pulse motor 48, and pulse motor 56.

The above described controller 65 of sewing machine M varies the size of needle thread loop 11*a* by lifting presser foot 53 to a predetermined height in coordination with the lateral position of needle bar 12 and the height of needle bar 12 at the timing when beak 38 meets needle thread loop 11*a* during the ongoing sewing sequence.

Figure 18:
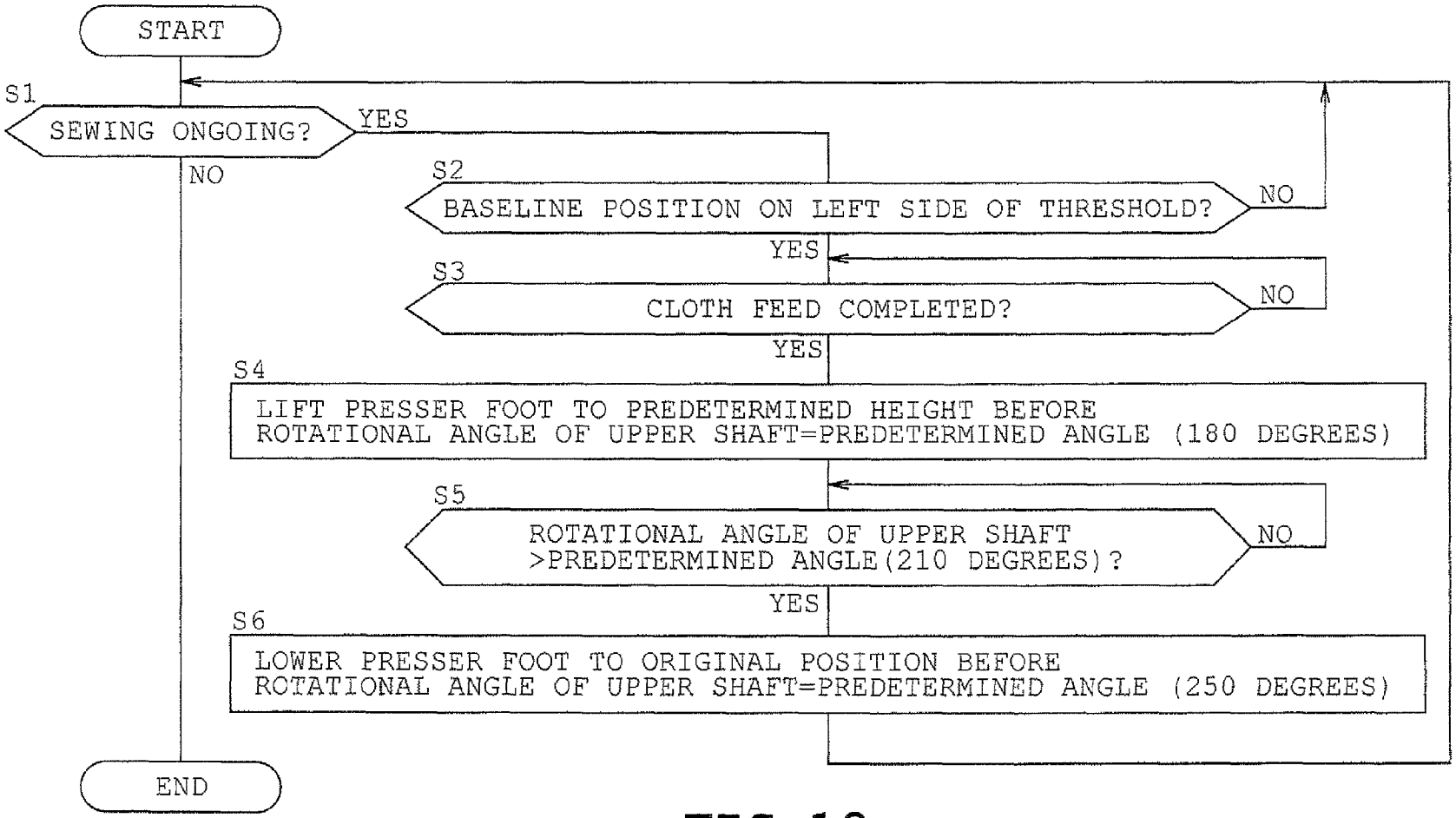
FIG. 18 is a flowchart indicating the control flow of a presser foot control.

Next, a step by step description will be given on the control flow of lifting/lowering of presser foot 53 based on the flowchart indicated in FIG. 18.

The control flow begins with step S1 in which controller 65 determines whether or not a sewing operation is ongoing. If sewing operation is ongoing (step S1: YES), controller 65 proceeds to step S2.

At step S2, controller 65 determines whether or not the baseline position, i.e., the lateral position of needle bar 12 is on the left side of predetermined threshold t. Step S2 is introduced in the control flow of the present exemplary embodiment so that lifting/lowering of presser foot 53 is executed only when needle bar 12 is positioned near left baseline position L where needle thread loop 11*a* tends to be oversized. In the present exemplary embodiment, a predetermined threshold t is, as shown in FIG. 2, located 7 mm to the left of right baseline position R, i.e., 2 mm to the right of left baseline L. Controller 65 stores a mapping of the count of pulses of pulse motor 48 for driving needle-bar swing mechanism 18 with the baseline position of sewing needle 13 and thus, determines the baseline position of needle bar 12 based on the count of pulses outputted by pulse motor 48 during the ongoing sewing operation.

When determining that the baseline position of needle bar 12 is on the right side of threshold t (step S2: No), controller 65 moves the process flow back to step S1. By contrast, when determining that the baseline position of needle bar 12 is on the left side of threshold t (step S2: YES), controller 65 proceeds to step S3. In the present exemplary embodiment, if it is found at step S2 that the baseline position of needle bar 12 coincides with threshold t, controller 65 is configured to proceed to step S3. In an alternative exemplary embodiment, controller 65 may be configured to move the process flow back to step S1 when the baseline position of needle bar 12 coincides with threshold t.

At step S3, controller 65 determines whether or not workpiece cloth W has been duly fed. Feeding, in this context, indicates the workpiece feeding executed by the feed mechanism which takes place after needle bar 12 is lifted out of workpiece cloth W and completed before needle bar 12 is descended through workpiece cloth W. In the present exemplary embodiment, feeding is deemed to have been completed if the rotational angle of upper shaft 23 is greater than a predetermined angle of, for instance, 140 degrees. Thus, controller 65 determines whether or not feeding has been completed based on whether or not the rotational angle of upper shaft 23 is greater than the predetermined angle which is 140 degrees.

Controller 65 repeats step S3 while a NO decision is made (step S3: NO) and when determining that rotational angle of upper shaft 23 has exceeded the predetermined angle of 140 degrees (step S3: YES), proceeds to step S4.

At step S4, controller 65 lifts presser foot 53 to a predetermined height before the rotational angle of upper shaft 23 reaches a predetermined angle of, for instance, 180 degrees where the height of needle bar 12 is at its lowermost point. The predetermined height, i.e., the lifting amount of presser foot 53 will be later elaborated. When the rotational angle of upper shaft 23 exceeds the predetermined angle of 180 degrees, needle bar 12 begins to rise from the lowermost point. With the rise of needle bar 12, needle thread loop 11*a* starts to form below needle plate 15 from needle thread 11 running between eye 13*b* of sewing needle 13 and workpiece cloth W. Thus, controller 65 starts to lift presser foot 53 to the predetermined height before needle bar 12 begins to rise from the lowermost point. Controller 65 is configured to store the height measurement of presser foot 53 at its original height into RAM 68 before it is lifted to higher elevation.

Next, controller 65 proceeds to step S5 to determine whether or not the rotational angle of upper shaft 23 has exceeded the predetermined angle of 210 degrees. As mentioned earlier, 210 degrees indicates the rotational angle where beak 38 seizes needle thread loop 11*a* at the left side timing LT when needle bar 12 is positioned in left baseline position L. Step S5 further provides a basis for controller 65 to determine whether or not the height of needle bar 12, varying in coordination with the rotation of upper shaft 23, has reached the predetermined height, i.e., the height appropriate for left side timing LT by determining whether or not the rotational angle of upper shaft has exceeded the predetermined angle of 210 degrees. Controller 65 repeats step S5 while a NO decision is made (step S5: NO) and when determining that rotational angle of upper shaft 23 has exceeded the predetermined angle of 210 degrees (step S5: YES), proceeds to step S6.

At step S6, controller 65 lowers presser foot 53 to the original height stored at step S4 where lifting of presser foot 53 is initiated before upper shaft 23 reaches a predetermined rotational angle of, for instance, 250 degrees which is a rotational angle immediately before sewing needle 13 is moved out of workpiece cloth W. Thus, controller 65 places workpiece cloth W in the depressed state by presser foot 53 before sewing needle 13 is completely moved out of workpiece cloth W.

When the sewing operation is ongoing, controller 65 repeats steps S1 to S6. When completing the sewing operation (step S1: NO), controller 65 terminates the control of lifting/lowering presser foot 53.

In summary, if needle bar 12 resides in left baseline L side relative to threshold t (step S2: YES), controller 65, after determining that feeding has been completed (step S3: YES), lifts presser foot 53 to the predetermined position (step S4). Step S3 is introduced because pressure applied on workpiece cloth W by presser foot 53 need not be maintained after feeding has been completed and lifting of presser foot 53 for resizing needle thread loop 11*a* will not affect the sewing sequence. To elaborate on step S4, controller 65 is configured to lift presser foot 53 to the predetermined height (step S4) before needle bar 12 is lowered to the lowermost point where rotational angle of upper shaft 23 indicates 180 degrees. This means that presser foot 53 is lifted to the predetermined height before needle bar 12 begins to rise from the lowermost position, in other words, before needle thread loop 11*a* starts to form. Thus, needle thread loop 11*a* is resized by lifting presser foot 53 as will be later described.

After beak 38 has seized needle thread loop 11*a* (step S5: YES), controller 65 lowers presser foot 53 to the original height (step S6). This is because the size of thread loop 11*a* need not be adjusted after beak 38 has seized needle thread loop 11*a*, and because it is better to depress workpiece cloth W with presser foot 53 before sewing needle 13 is moved out of workpiece cloth W to facilitate the exit of sewing needle 13 from workpiece cloth W. Another reason for lowering presser foot 53 is to depress workpiece cloth W with presser foot 53 in preparation for the subsequent feeding of workpiece cloth W.

Next, a description will be given on the relation between the height of presser foot 53 at step S4 and the size of resulting needle thread loop 11*a* with reference to FIGS. 19 to 23. In order for beak 38 to seize needle thread loop 11*a*, needle loop 11*a* needs to be formed on the rear side of sewing needle 13 or the right side of sewing needle 13 as viewed in FIGS. 19 to 23. Thus, to prevent needle thread loop 11*a* from being formed on the front side of sewing needle 13 or the left side of sewing needle 13 as viewed in FIGS. 19 to 23, a guide wall is provided within inner hook not shown.

Figure 19:
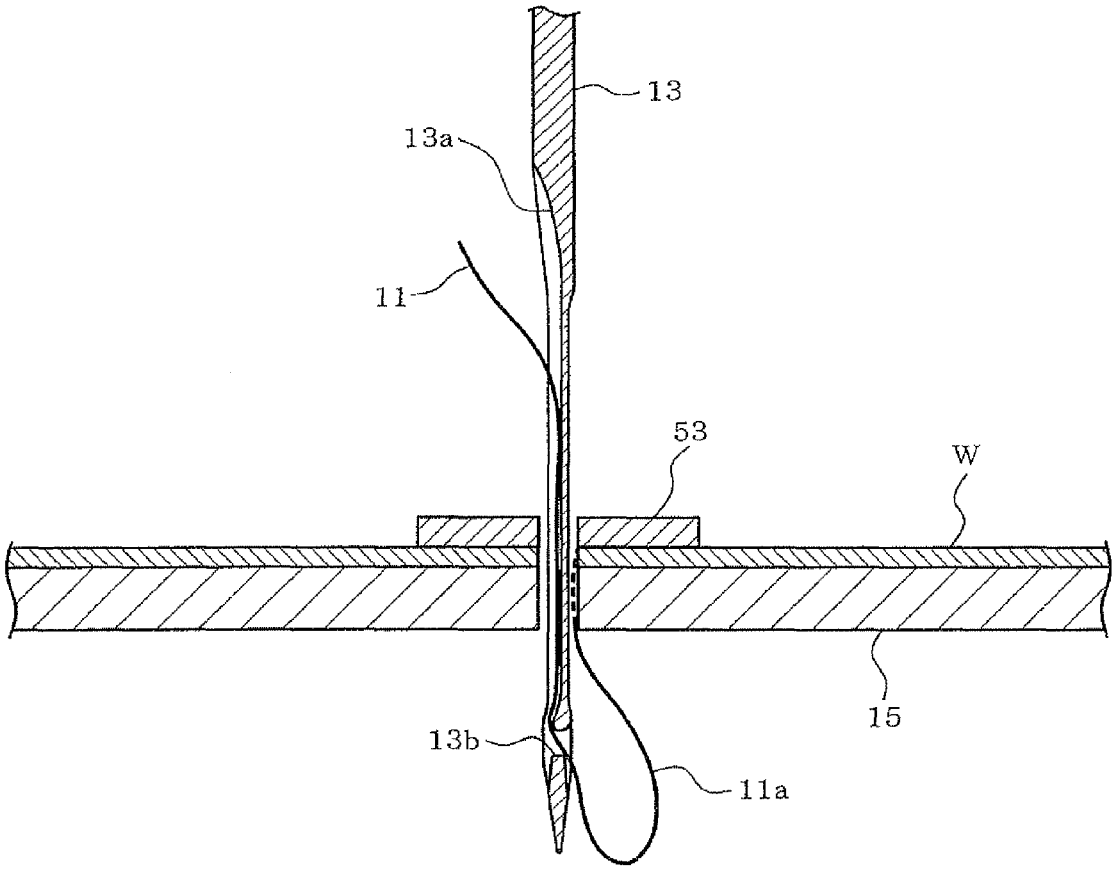
FIGS. 19 to 23 illustrate variations in the size of needle thread loop at different heights of the presser foot.

FIG. 19 illustrates the case where the amount of elevation of presser foot 53 is 0, meaning that presser foot 53 maintains its original height and is not lifted. In this case, because workpiece cloth W stays depressed against upper surface of needle plate 15 by presser foot 53, workpiece cloth W is not allowed to rise with sewing needle 13. Thus, relatively greater length of needle thread 11 remains below needle plate 15, resulting in a sizable needle thread loop 11*a*. Needle thread loop 11*a*, when oversized, tends to sag and collapse to loose its looped shape, thereby failing to be seized by beak 38.

Figure 20:
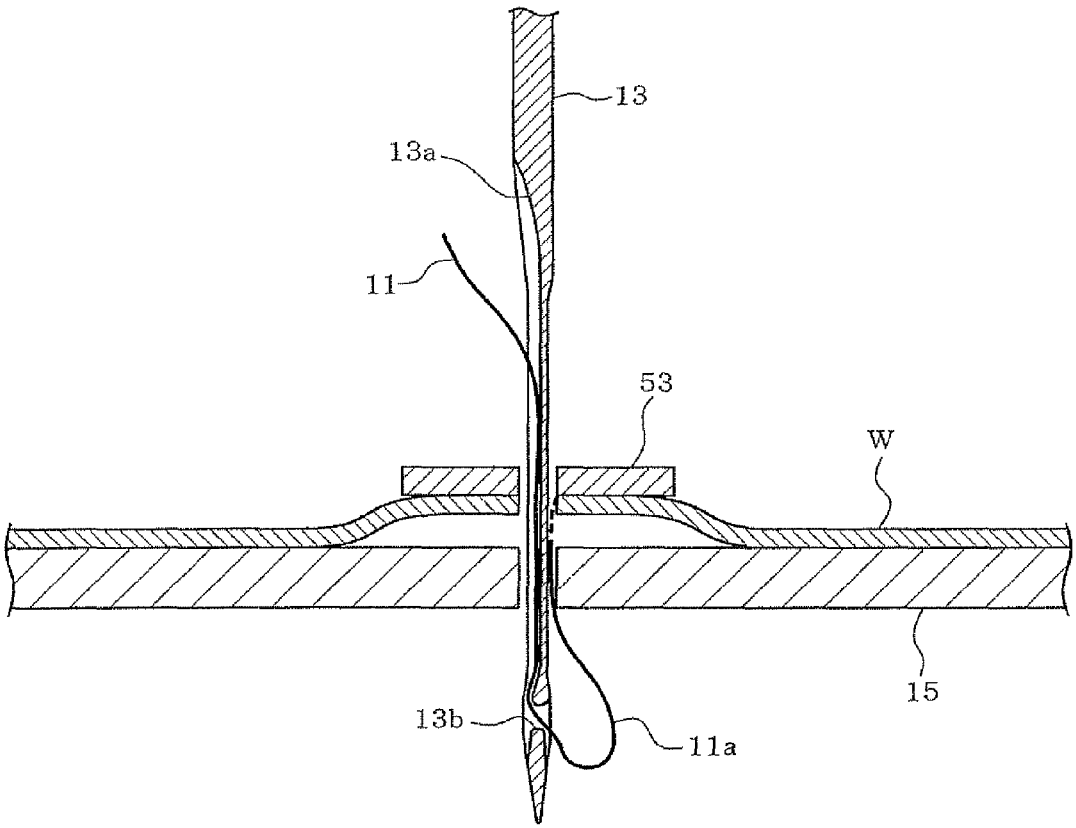
Figure 21:
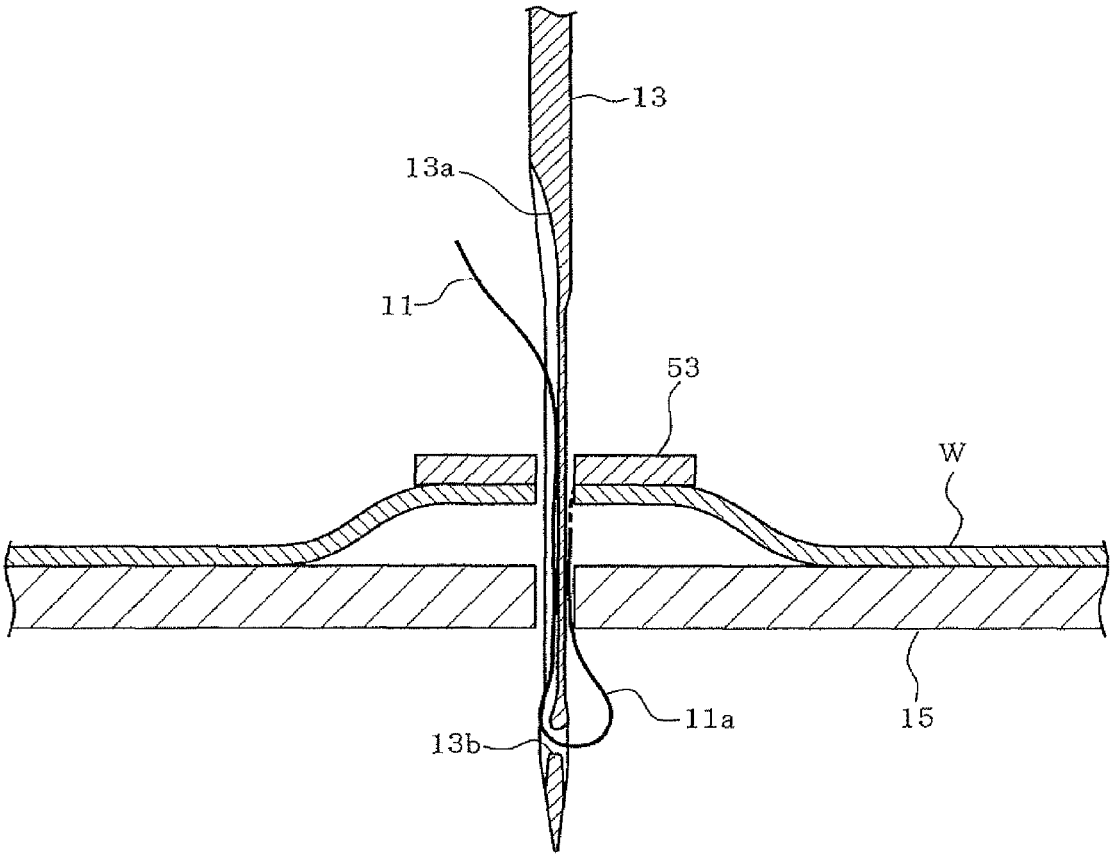

By contrast, FIG. 20 illustrates the case where presser foot 53 is lifted by 0.5 mm and FIG. 21 illustrates the case where presser foot 53 is lifted by 0.75 mm. In these cases, workpiece cloth W is allowed to rise with sewing needle 13 because presser foot 53 is lifted. Thus, relatively less amount of needle thread 11 remains below needle plate 15 compared to the case where presser foot 53 is not lifted to relatively reduce the size of needle thread loop 11*a* being formed. Needle thread loop 11*a*, when formed in the appropriate size, does not sag or collapse by gravity and thus, maintains its looped shape to be more successfully seized by beak 38.

Figure 22:
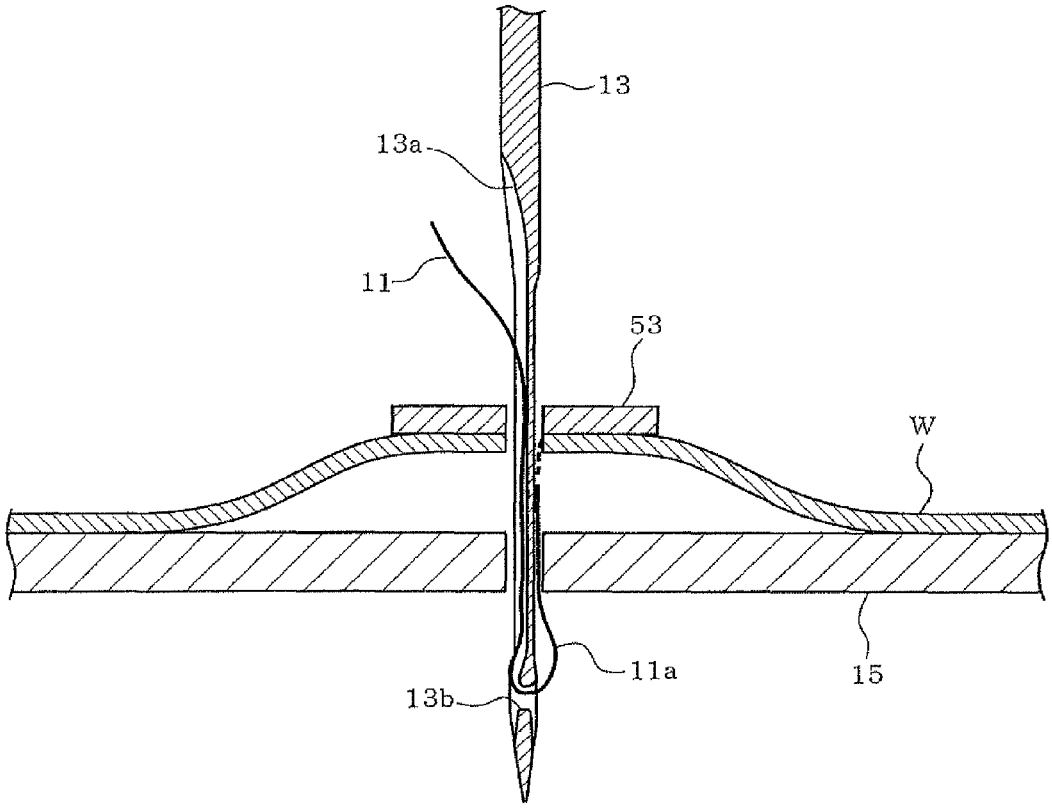
Figure 23:
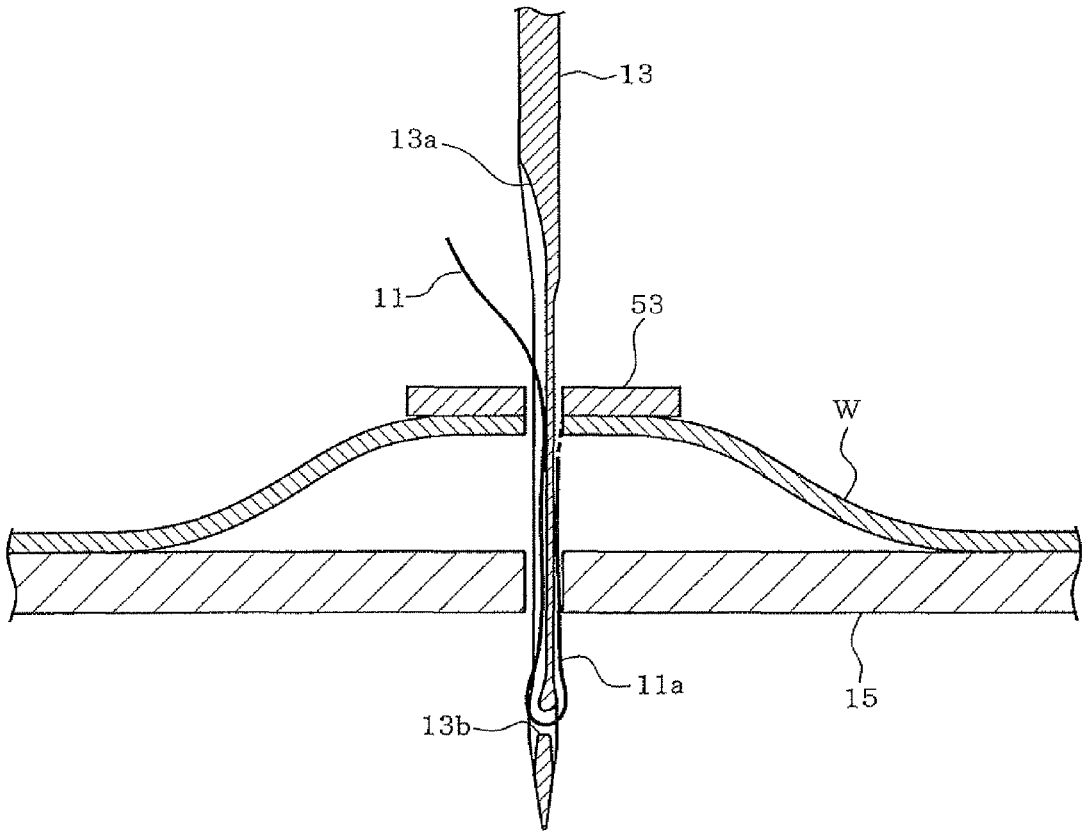

FIG. 22 illustrates the case where presser foot 53 is lifted by 1.0 mm and FIG. 23 illustrates the case where presser foot 53 is lifted by 1.25 mm. In these cases, presser foot 53 is lifted excessively, leaving insufficient amount of needle thread 11 below needle plate 15, and thus, only allows formation of needle thread loop 11*a* which may be too small to be seized by beak 38.

In application, optimal amount of presser foot 53 elevation varies depending upon usage such as: the type and thickness of needle thread 11, thickness of sewing needle 13, workpiece material and the combination of the foregoing. Thus, the predetermined height of presser foot 53 stored in sewing machine M is specified at an average value reflective of different usage scenarios. In an alternative exemplary embodiment, the user may be allowed to edit the amount of elevation of presser foot 53 as appropriate.

According to the exemplary embodiment set forth above, controller 65 determines whether or not the baseline position of needle bar 12 is on the left side of the predetermined threshold t (step S2), senses the height of needle bar 12 based on the rotational angle of upper shaft 23 (step S3), and lifts presser foot 53 to the predetermined height (step S4) in response to the results of the preceding steps to resize needle thread loop 11*a*. The size of needle thread loop 11*a* can be optimized through adjustment in the height, in other words, the amount of elevation of presser foot 53 to allow needle thread loop 11*a* to be reliably seized by beak 38. Thus, skipped stitches can be prevented by utilizing presser foot lifting/lowering mechanism 20 that moves presser foot 53 up and down.

Controller 65 detects the rotational angle, in other words, the rotational phase of upper shaft 23 for driving needle-bar lifting/lowering mechanism 16 by rotational angle detection mechanism 32 and controls presser foot lifting/lowering mechanism 20 depending upon the detected rotational angle of upper shaft 23. Thus, presser foot 53 can be lifted in more precise coordination with the lifting/lowering of needle bar 12 to allow needle thread loop 11*a* to be resized more precisely, thereby preventing skipped stitches more effectively.

In the present exemplary embodiment, controller 65 is configured to selectively control presser foot lifting/lowering mechanism 20 when needle bar 12 resides within a predetermined sub-range within the swingable range of needle bar 12. The swingable range, as mentioned earlier, spans between right baseline position R and left baseline position L, and the predetermined sub-range in this case spans leftward beyond threshold t to the left baseline position L. Stated differently, controller 65 is configured to lift presser foot 53 when needle bar 12 resides within the predetermined sub-range on left baseline position L side where needle thread loop 11*a* tends to be oversized. As described above, controller 65 lifts/lowers presser foot 53 in more precise coordination with the height of needle bar 12. Precise lifting of presser foot 53 allows more precise resizing of needle thread loop 11*a* to prevent skipped stitches more effectively.

By contrast, controller 65 is configured to prohibit the lifting of presser foot 53 when needle bar 12 resides at the right baseline position R which is also referred to as the first swing position (step S2: NO) to keep workplace cloth W depressed by presser foot 53. When needle bar 12 resides at left baseline position L, i.e., the second swing position (step S2: YES), presser foot 53 is lifted to the predetermined height (step S4), as mentioned earlier. Such difference in presser foot 53 control allows the size of needle thread loop 11*a* seized by beak 38 at different positions/timings to be substantially uniform. More specifically, the above described control allows the size of needle thread loop 11*a* seized by beak 38 at the second rotational position where beak 38 encounters needle thread loop 11*a* at left-side timing LT to be resized so as to approximate the size of needle thread loop 11*a* seized by beak 38 at the first rotational position where beak 38 encounters needle thread loop 11*a* at right-side timing RT.

It can be understood from the foregoing that the size of needle thread loop 11*a* seized by beak 38 at the second rotational position relies on the size of needle thread loop 11*a* seized by beak 38 at the first rotational position. Thus, if the size of needle thread loop 11*a* at the first rotational position is appropriately sized to facilitate its seizure by beak 38, the size of needle thread loop 11*a* at the second rotational position will adjust accordingly to facilitate the seizure by beak 38. Accordingly, needle thread loop 11*a* can be readily seized by beak 38 regardless of whether needle bar 12 resides in right base line position R where beak 38 is at the first rotational position or left baseline position L where beak 38 is at the second rotational position. Again, skipped stitches can be prevented more effectively by utilizing presser foot lifting/lowering mechanism that moves presser foot 53 up and down.

The present disclosure is not limited to the exemplary embodiment described above.

Controller 65 may be configured to specify the height of presser foot 53 depending upon the thickness of workpiece cloth W detected by potentiometer 62. By introducing such feature, controller 65 may control presser foot lifting/lowering mechanism 20 based on "the lateral position of needle bar 12", "the height of needle bar 12 at the timing where beak 38 meets needle thread loop 11*a*", "the rotational angle, i.e., rotational phase of upper shaft 23 for driving needle bar lifting/lowering mechanism 16", and further, "the height of presser foot 53 specified based on the thickness of workpiece cloth W". Thus, the lifting of presser foot 53 can be carried out in consideration of the thickness of workpiece cloth W. Accordingly, needle thread loop 11*a* can be resized with greater precision through lifting of presser foot 53 to prevent skipped stitches more effectively. The thickness detection of workpiece cloth W may be carried out at the beginning of the sewing operation, or in the appropriate timing while the sewing operation is ongoing.

In the above described exemplary embodiment, the size of needle thread loop 11*a* seized by beak 38 at left-side timing LT, i.e. the second rotational position when needle bar 12 is positioned in the left baseline position L is adjusted to approximate the size of needle thread loop 11*a* which is seized by beak 38 at right-side timing RT, i.e., the first rotational position when needle bar 12 is positioned in the right baseline position R. In an alternative exemplary embodiment, the size of needle thread loop 11*a* when needle bar 12 is in the right-side baseline position R may be adjusted based on the size of needle thread loop 11*a* when needle bar 12 is positioned in the left-side baseline position L. Further, the sizes of needle thread loops 11*a* when needle bar 12 is positioned in the left baseline position L and the right baseline position R may be adjusted based on the size of needle thread loop 11*a* when needle bar 12 is positioned in mid baseline position C. Still further, the sizes of needle thread loops 11*a* of left baseline position L, right baseline position R, and mid baseline position C may be adjusted independently.

Threshold t discussed at step S2 for determining the lateral position of needle bar 12 may be varied as required as long as it stays on the left side of mid baseline C.

In a typical electronic sewing machine such as those that may be employed in the present disclosure, sewing operation is carried out based on sew data containing needle swing data for controlling the needle swing amount of needle bar 12 and feed data for controlling the feed amount of workpiece cloth W or the feed amount of the feed dog. In determining the lateral position of needle bar 12, controller may be configured to utilize needle swing data read when encountering step S2 of the control flow.

The lifting amount of presser foot 53 at step S4 may be modified depending upon the size of the desired needle thread loop 11*a*.

The rotational angle of upper shaft 23 for determining the completion of feeding discussed at step S3 may be modified depending upon the feed amount in which workpiece cloth W is fed. For instance, the maximum feed amount is set at 4 to 5 mm in the present exemplary embodiment. Once feeding has been completed, workpiece cloth W no longer needs to be depressed by presser foot 53. Thus, presser foot 53 may be lifted immediately after feeding has been completed before the rotational angle of upper shaft 23 reaches 140 degrees.

The swingable range or the swing width of needle bar 12 may be modified as required. Under such configuration, the size of needle thread loop 11*a* will vary with increased/decreased swingable range. Thus, controller 65 may be configured to adjust the lifting amount of presser foot 53 by presser foot lifting/lowering mechanism 20 depending upon the specified swingable range of needle bar 12 as well.

Controller 65 may be configured to control the amount of elevation of presser foot 53 by presser foot lifting/lowering mechanism 20 depending upon the rotational speed of upper shaft 23. Controller 65 may be further configured to control the amount of elevation of presser foot 53 by presser foot lifting/lowering mechanism 20 depending upon the type of needle thread 11 and other various parameters for driving sewing machine M.

The hook provided at hook drive mechanism 19 is not limited to horizontal rotary hook 34 but may also employ a vertical rotary hook.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a needle bar that allows attachment of a sewing needle including a needle eye to a lower end thereof;

a needle-bar swing mechanism that swings the needle bar;

a needle-bar lifting/lowering mechanism that moves the needle bar up and down;

an upper shaft that drives the needle-bar lifting/lowering mechanism;

a presser foot that presses a workpiece cloth;

a presser foot lifting/lowering mechanism that moves the presser foot up and down;

a hook that is provided with a beak for seizing a needle thread loop formed at the needle eye and that rotates in coordination with the up and down movement of the needle bar;

a rotational phase detector that detects a rotational phase of the upper shaft; and a controller that controls drive of the presser foot lifting/lowering mechanism;

wherein the controller controls the presser foot lifting/lowering mechanism so as to resize the needle thread loop by lifting the presser foot to a predetermined height in coordination with a swing position of the needle bar and a height of the needle bar where the beak meets the needle thread, and the controller controls the presser foot lifting/lowering mechanism based on the rotational phase of the upper shaft detected by the rotational phase detector.

2. The sewing machine according to claim 1, wherein the controller controls the presser foot lifting/lowering mechanism when the swing position of the needle bar is within a predetermined sub-range within a swingable range of the needle bar.

3. The sewing machine according to claim 1, wherein the needle-bar swing mechanism swings the needle bar between a first swing position and a second swing position, and the beak seizes the needle thread loop at a first rotational position which is a first meeting timing where the needle bar is in the first swing position and at a second rotational position which is a second meeting timing where the needle bar is in the second swing position, and wherein the controller, when the needle bar is in the first swing position, does not allow lifting of the presser foot to keep the workpiece cloth pressed by the presser foot, whereas when the needle bar is in the second swing position, allows lifting of the presser foot to a predetermined height such that the needle thread loop seized by the beak at the second rotational position can be resized so as to proximate a size of the needle thread loop seized at the first rotational position.

4. The sewing machine according to claim 1, further comprising:

a thickness detector that detects a thickness of the workpiece cloth, and a specifier that specifies a height to which the presser foot is to be lifted based on the thickness detected by the thickness detector, wherein the controller controls the presser foot lifting/lowering mechanism based on the height of the presser foot specified by the specifier.

5. The sewing machine according to claim 2, further comprising:

a thickness detector that detects a thickness of the workpiece cloth, and a specifier that specifies a height to which the presser foot is to be lifted based on the thickness detected by the thickness detector, wherein the controller controls the presser foot lifting/lowering mechanism based on the height of the presser foot specified by the specifier.

6. The sewing machine according to claim 3, further comprising:

a thickness detector that detects a thickness of the workpiece cloth, and a specifier that specifies a height to which the presser foot is to be lifted based on the thickness detected by the thickness detector, wherein the controller controls the presser foot lifting/lowering mechanism based on the height of the presser foot specified by the specifier.

* * * * *